US010185248B2

(12) United States Patent
Kato

(10) Patent No.: US 10,185,248 B2
(45) Date of Patent: Jan. 22, 2019

(54) DEVELOPING DEVICE AND IMAGE FORMING APPARATUS HAVING A DEVELOPER-LEVEL ADJUSTING MAGNETIC POLE

(71) Applicant: FUJI XEROX CO., LTD., Tokyo (JP)

(72) Inventor: Nao Kato, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,963

(22) Filed: Sep. 8, 2017

(65) Prior Publication Data

US 2018/0267431 A1 Sep. 20, 2018

(30) Foreign Application Priority Data

Mar. 16, 2017 (JP) ..... 2017-051412

(51) Int. Cl.
*G03G 15/09* (2006.01)
*G03G 15/08* (2006.01)

(52) U.S. Cl.
CPC ..... *G03G 15/0889* (2013.01); *G03G 15/0812* (2013.01); *G03G 15/0891* (2013.01)

(58) Field of Classification Search
CPC ..... G03G 15/0868; G03G 15/0865; G03G 15/0832
See application file for complete search history.

(56) References Cited

U.S. PATENT DOCUMENTS

2005/0281588 A1* 12/2005 Okuda ..... G03G 15/0893 399/254
2016/0139541 A1* 5/2016 Inada ..... G03G 15/0893 399/254

FOREIGN PATENT DOCUMENTS

JP 2005-017935 A 1/2005
JP 2015-011228 A 1/2015
JP 2015-011288 A 1/2015

OTHER PUBLICATIONS

English machine translation of JP 2015-011228.*
English machine translation of JP 2015-011288.*

* cited by examiner

*Primary Examiner* — Walter L Lindsay, Jr.
*Assistant Examiner* — Arlene Heredia
(74) *Attorney, Agent, or Firm* — Sughrue Mion, PLLC

(57) ABSTRACT

A developing device includes a housing including a container that holds a developer containing toner and a magnetic carrier, a feed port member that allows toner or a magnetic carrier to pass therethrough to be fed into the container, a rotary member spaced apart by a gap from a surrounding portion of the housing including the feed port member, the rotary member transporting the developer while holding the developer on an outer circumferential surface of the rotary member to cover the gap when a developer level of the developer inside the container exceeds a reference level, and a developer-level adjusting magnetic pole that holds the developer and that is located at the same level as an end of the gap located downstream from the feed port member in a rotation direction of the rotary member or located downstream from the end of the gap in the rotation direction.

8 Claims, 15 Drawing Sheets

DEVELOPING DEVICE AND IMAGE FORMING APPARATUS HAVING A DEVELOPER-LEVEL ADJUSTING MAGNETIC POLE

CROSS-REFERENCE TO RELATED APPLICATIONS

This application is based on and claims priority under 35 USC 119 from Japanese Patent Application No. 2017-051412 filed Mar. 16, 2017.

BACKGROUND

Technical Field

The present invention relates to a developing device and an image forming apparatus.

SUMMARY

According to an aspect of the invention, A developing device includes a housing including a container that holds a developer containing toner and a magnetic carrier, a feed port member that allows toner or a magnetic carrier to pass therethrough to be fed into the container, a rotary member spaced apart by a gap from a surrounding portion of the housing including the feed port member, the rotary member transporting the developer while holding the developer on an outer circumferential surface of the rotary member to cover the gap when a developer level of the developer inside the container exceeds a reference level, and a developer-level adjusting magnetic pole that holds the developer and that is located at the same level as an end of the gap located downstream from the feed port member in a rotation direction of the rotary member or located downstream from the end of the gap in the rotation direction.

BRIEF DESCRIPTION OF THE DRAWINGS

Exemplary embodiments of the present invention will be described in detail based on the following figures, wherein.

DETAILED DESCRIPTION

Modes for embodying the present invention (hereinafter referred to as "exemplary embodiments") are described with reference to the drawings, below.

First Exemplary Embodiment

Figure 1:
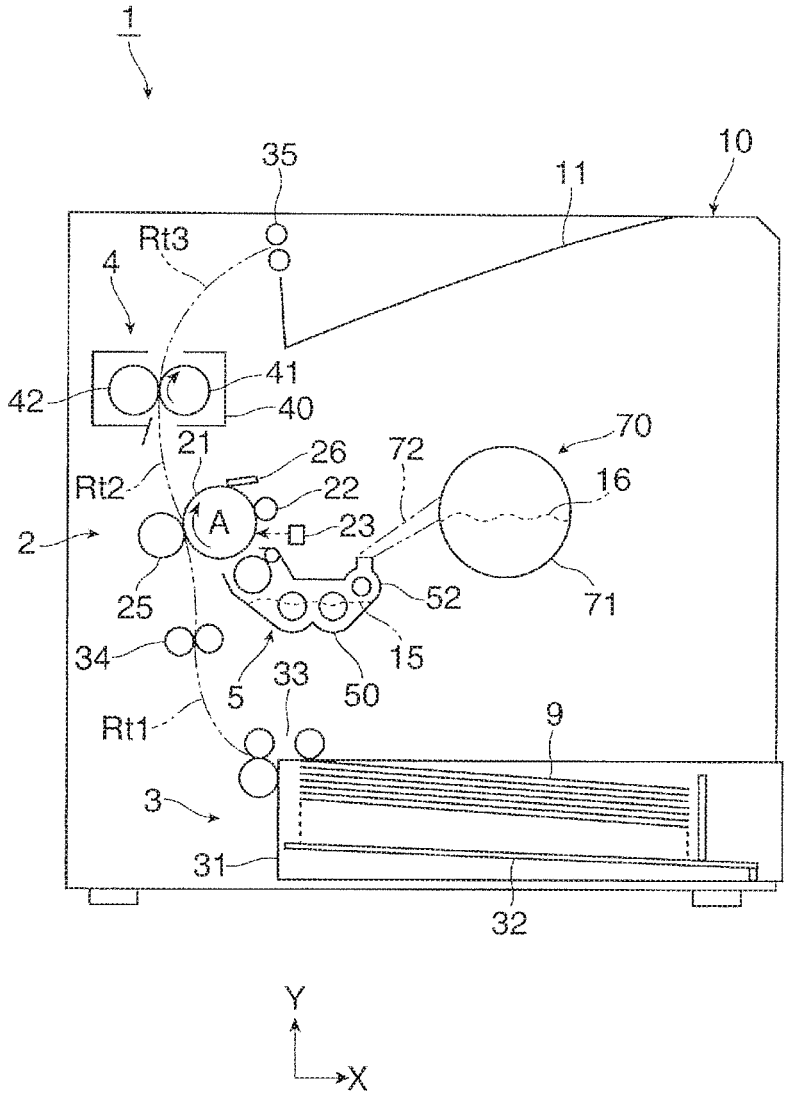
FIG. 1 illustrates the entirety of an image forming apparatus according to a first exemplary embodiment and other embodiments.
Figure 2:
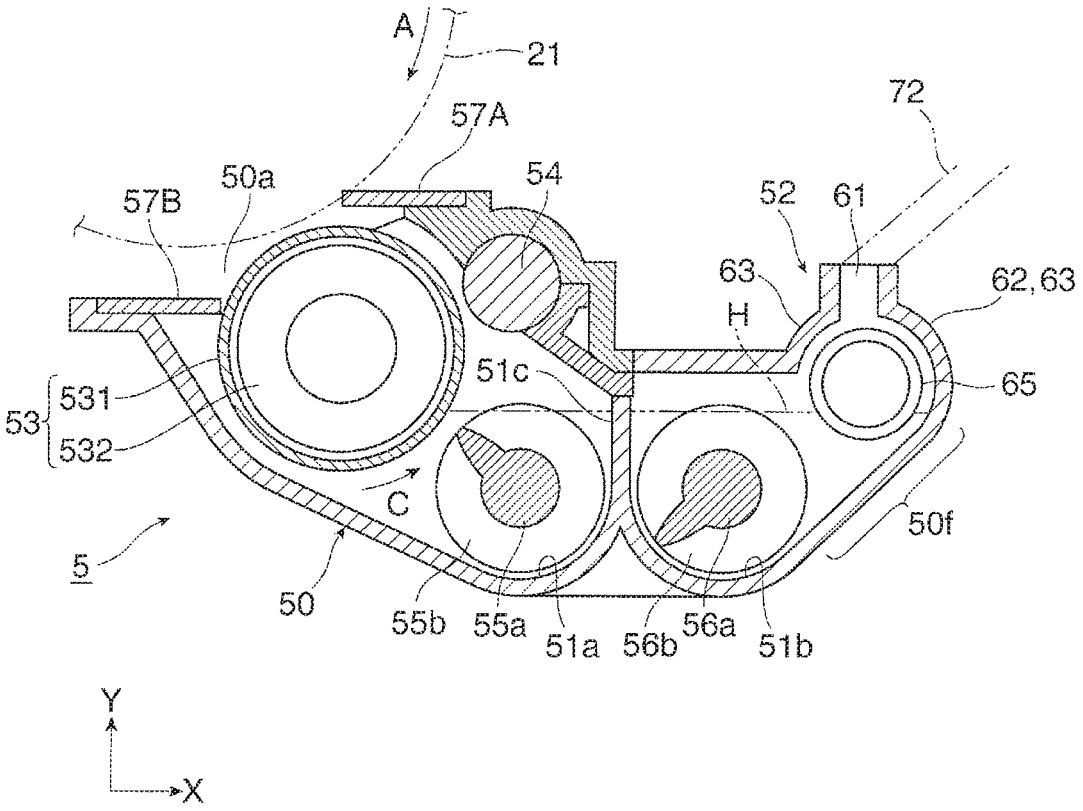
FIG. 2 is a sectional view of a developing device of the image forming apparatus in FIG. 1.
Figure 3:
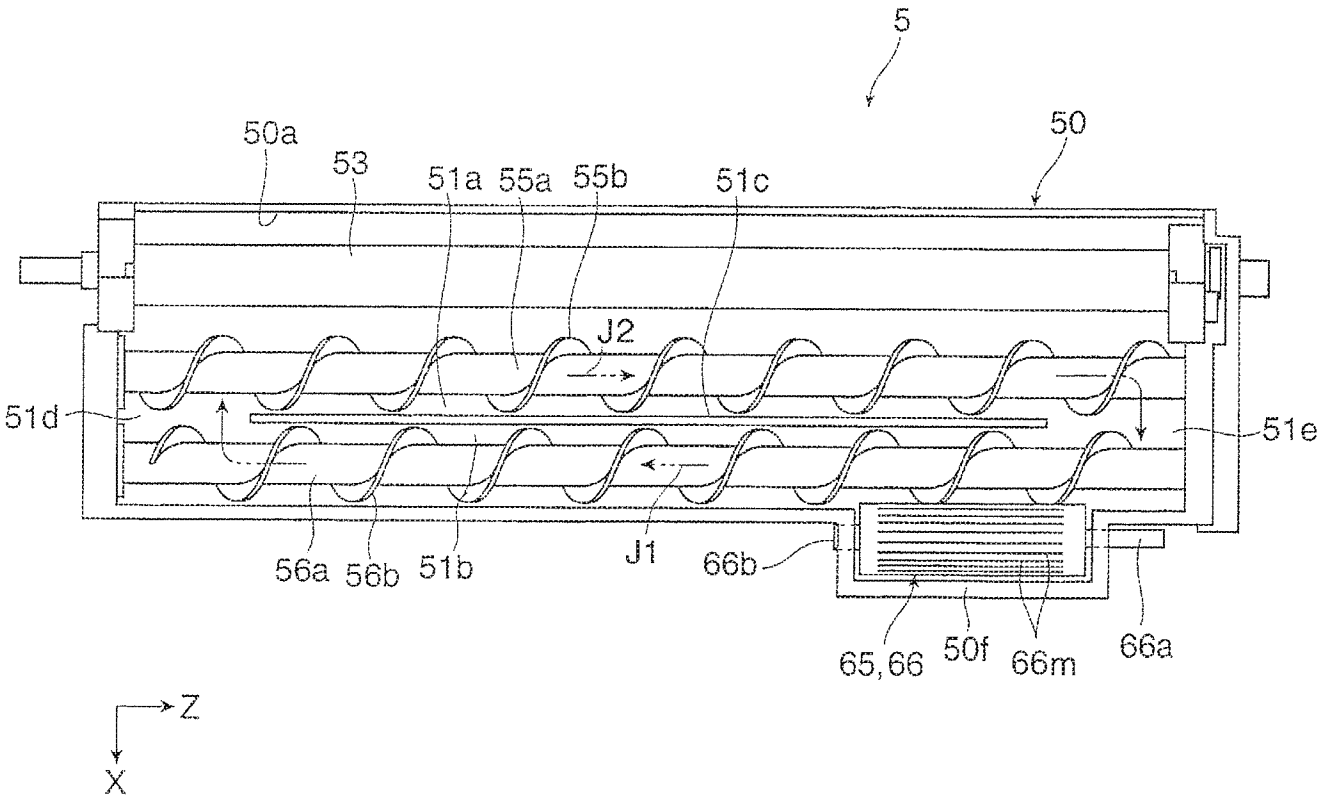
FIG. 3 is a plan view of a part of the developing device illustrated in FIG. 2.

FIGS. 1 to 3 illustrate an image forming apparatus according to a first exemplary embodiment. FIG. 1 illustrates a structure of the image forming apparatus. FIG. 2 illustrates a structure of a developing device included in the image forming apparatus. FIG. 3 illustrates a part of the structure of the developing device. Arrows denoted with reference signs X, Y, and Z in the drawings including FIG. 1 are (directions of) rectangular coordinate axes indicating the directions of the width, height, and depth of a three-dimensional space assumed in each drawing.

Entire Structure of Image Forming Apparatus

As illustrated in FIG. 1, an image forming apparatus 1 includes an image forming device 2, a sheet feeding device 3, and a fixing device 4, inside a housing 10, which is an apparatus body. The image forming device 2 forms images from toner, serving as a developer, and finally transfers the images to recording sheets 9, which are an example of recording media. The sheet feeding device 3 holds predetermined recording sheets 9 and feeds the sheets 9 to a transfer position of the image forming device 2. The fixing device 4 fixes a toner image transferred to a recording sheet 9. The housing 10 includes components such as structural components and covering members. The reference sign 11 in FIG. 1 and other drawings denotes a container that holds recording sheets 9 subjected to image formation and discharged thereto. The container 11 is disposed on the upper surface of the housing 10.

The image forming device 2 includes a photoconductor drum 21, a charging device 22, an exposure device 23, a developing device 5, a transfer device 25, and a cleaning device 26. The photoconductor drum 21 is an example of an image carrier that is driven to rotate in a direction of arrow A. The charging device 22 charges the circumferential surface (a portion of the outer circumferential surface serving as an image-receiving area) of the photoconductor drum 21 with a predetermined potential. The exposure device 23 radiates light based on image information (signals) to the charged circumferential surface of the photoconductor drum 21 to form an electrostatic latent image thereon. The developing device 5 develops the electrostatic latent image on the photoconductor drum 21 with toner, serving as a developer, into a toner image. The transfer device 25 transfers a toner image on the photoconductor drum 21 to a recording sheet 9. The cleaning device 26 removes unwanted components, such as toner remaining on the circumferential surface of the photoconductor drum 21, to clean the circumferential surface.

The photoconductor drum 21 is a component obtained by forming a photodielectric layer, formed from a material such as an organic photosensitive material, on, for example, the outer circumferential surface of a cylindrical electrically conductive body. Examples used as the charging device 22 include a contact-type charging device including a contact member (such as a driven roller) that comes into contact with the circumferential surface of the photoconductor drum 21 and that is charged with, for example, a charging current from a power supply device, not illustrated.

The exposure device 23 performs light exposure based on an image signal obtained after an image processor, not illustrated, performs predetermined processing on image information input to the image forming apparatus 1 from an image information source connected thereto or included therein, such as a document reader, an external connection device, or a recording medium reader. Examples used as the exposure device 23 include a line-type device in which multiple light emitting diodes are arranged in a row along the direction of the rotation axis of the photoconductor drum 21 and a scanning-type device that exposes the photoconductor drum 21 with light from a semiconductor laser so as to scan the photoconductor drum 21 in the axial direction using multiple types of optical components including a rotating polygon mirror. The developing device 5 is described in detail later.

An example used as the transfer device 25 is a contact-type transfer device that performs transfer by feeding transfer current or the like from a power supply device, not illustrated, to a pressing member (a roller or a brush that is driven to rotate) that touches the circumferential surface of the photoconductor drum 21 to press a recording sheet 9 against the circumferential surface of the photoconductor drum 21 and causes the recording sheet 9 to pass thereby in a transfer process. An example of the cleaning device 26 is a contact-type cleaning device that includes, for example, a plate-shaped cleaning member that touches the circumferential surface of the photoconductor drum 21.

The sheet feeding device 3 includes a sheet container 31 and a discharging device 33. The sheet container 31 holds a stack of multiple recording sheets 9, having predetermined sizes and types for image formation, on a sheet mount board 32. The discharging device 33 picks up the recording sheets 9 held in the sheet container 31 one by one. The sheet container 31 is attached to the housing 10 so as to be removable. Multiple sheet containers 31 may be provided in accordance with the mode of use. Examples of the recording sheets 9 include recording media cut into predetermined sizes and formed from plane paper, coated paper, and cardboard.

The fixing device 4 includes a heating rotary member 41 and a pressing rotary member 42 inside a housing 40 having an inlet port and an outlet port. The heating rotary member 41 is in a form, such as a roller form or a belt form. The heating rotary member 41 is driven to rotate in the direction of the arrow. The heating rotary member 41 has its circumferential surface temperature heated to and kept at a predetermined temperature by a heater, not illustrated. The pressing rotary member 42 is in a form, such as a roller form or a belt-pad form. The pressing rotary member 42 is driven to rotate by a contact with the heating rotary member 41 approximately in an axial direction of the heating rotary member 41 with a predetermined pressure. A contact portion of the fixing device 4 at which the heating rotary member 41 and the pressing rotary member 42 come into contact with each other serves as a fixing processing portion that allows a recording sheet 9 to which an unfixed toner image has been transferred to pass therethrough to subject the recording sheet 9 to a predetermined fixing process (heating and pressing).

As indicated with two-dot chain lines Rt1, Rt2, and Rt3 in FIG. 1, the image forming apparatus 1 includes broad sheet transport paths along which the recording sheet 9 passes inside the housing 10. The broad sheet transport paths include a feed transport path Rt1, a relay transport path Rt2, and an outlet transport path Rt3. The feed transport path Rt1 is located between the discharging device 33 of the sheet feeding device 3 and the transfer position of the image forming device 2 (a portion opposing the transfer device 25 of the photoconductor drum 21). The relay transport path Rt2 is located between the transfer position of the image forming device 2 and the fixing processing portion of the fixing device 4. The outlet transport path Rt3 is located between the fixing processing portion of the fixing device 4 and the container 11 of the housing 10.

The feed transport path Rt1 includes a pair of transport rollers 34 and multiple transport guide members, not illustrated. The pair of transport rollers 34 serves as a pair of registration rollers. While stops rotating, the pair of transport rollers 34 allows the end of the recording sheet 9 transported from the sheet feeding device 3 to come into contact with itself to straighten the form of the entirety of the recording sheet 9 inclined during transportation. Then, the pair of transport rollers 34 starts rotating at the transfer timing to transport the recording sheet 9 to the transfer position. The relay transport path Rt2 includes multiple transport guide members, not illustrated. The outlet transport path Rt3 includes a pair of transport rollers 35 and multiple transport guide members, not illustrated. The pair of transport rollers 35 serves as outlet rollers that transport the recording sheet 9 subjected to fixing to the container 11.

The image forming apparatus 1 performs image formation in the following manner. Here, a basic image formation operation to form an image on a single side of the recording sheet 9 is described as an example.

When a controller, not illustrated, receives a command to start an image formation operation, the following operations start in the image forming device 1. The photoconductor drum 21 starts rotating. The charging device 22 charges the circumferential surface of the photoconductor drum 21 with a predetermined polarity and potential (the negative polarity in this example). Then, the exposure device 23 exposes the charged circumferential surface of the photoconductor drum 21 to light based on image information to form an electrostatic latent image of a predetermined pattern. Subsequently, the developing device 5 feeds toner, serving as a developer charged with a predetermined polarity (the negative polarity in this example), to the electrostatic latent image formed on the circumferential surface of the photoconductor drum 21 to develop the electrostatic latent image into a visible toner image.

Thereafter, the photoconductor drum 21 rotates to transport the toner image to the transfer position opposing the transfer device 25. On the other hand, the sheet feeding device 3 feeds the recording sheet 9 to the feed transport path Rt1 at the transfer timing toward the transfer position of the image forming device 2. At the transfer position of the image forming device 2, the transfer device 25 transfers the toner image on the photoconductor drum 21 to one side of the recording sheet 9 usually with an electrostatic effect. The cleaning device 26 cleans, for example, the circumferential surface of the photoconductor drum 21 after the transfer.

Subsequently, the rotated photoconductor drum 21 transports the recording sheet 9 to which a toner image has been transferred to the relay transport path Rt2 toward the fixing device 4. The fixing device 4 allows the recording sheet 9 to be introduced into and passed through the fixing processing portion between the heating rotary member 41 and the pressing rotary member 42, which are driven to rotate. When passing through the fixing processing portion, the toner of the toner image on one side of the recording sheet 9 is melt under pressure and thus fixed to the recording sheet 9.

Finally, the recording sheet 9 subjected to fixing is fed to the outlet transport path Rt3 from the fixing processing portion of the fixing device 4, then discharged from the outlet port of the housing 10 by a pair of discharging rollers 35, and finally held in the container 11.

By the above processing, a single color image formed of a single color toner is formed on one side of a single recording sheet 9, and a basic image forming operation is finished. When a command to execute an image formation operation on multiple sheets is issued, the above-described procedure is repeated the number of times equal to the number of sheets.

Structure of Developing Device

The developing device 5 is described now.

As illustrated in FIGS. 2 and 3 and other drawings, the developing device 5 includes a housing 50 that houses components in position. The housing 50 houses components including a development roller 53, a layer-thickness restricting member 54, and two agitating transport members 55 and 56.

As illustrated in FIG. 3, the housing 50 is a structure whose entire contour extends in one direction. The housing 50 is a structure including a container portion 51, which holds the developer 15, a development opening 50*a*, which is a portion of the container portion 51 that is open to face the photoconductor drum 21, and a toner feeder 52, which allows the developer (toner in this example) 15 to pass therethrough, the developer 15 being refilled in the container portion 51 in accordance with the reduction of the developer 15 in the container portion 51 after consumed during the development operation.

The housing 50 is divided into, for example, a body portion (a housing bottom), serving as a lower structure of the housing 50, and a lid portion (a housing top), covering the top of the body portion and serving as an upper structure of the housing 50. An example used as the developer 15 is a two-component developer, which is a developer containing toner formed from colored (such as black) fine particles and a magnetic carrier formed from magnetic particles.

The container portion 51 of the housing 50 has a shape including two rows of transport paths 51*a* and 51*b* (a first transport path 51*a* and a second transport path 51*b*), extending parallel to the axial direction of the development roller 53.

The two rows of the transport paths 51*a* and 51*b* are transport paths extending linearly parallel to each other. The portion between the adjacent transport paths is partitioned by a partitioning wall 51*c*, but the transport paths form a circulation path while being connected to each other at connection portions 51*d* and 51*e* at an upstream end and a downstream end in the transport direction, to which the partitioning wall 51*c* does not extend. Of the two rows of transport paths 51*a* and 51*b*, the first transport path 51*a* closer to the development roller 53 usually serves as a feed transport path for feeding the developer to the development roller 53 and the second transport path 51*b* further from the development roller 53 usually serves as a mixing transport path for mixing the developer with fed toner.

The development opening 50*a* has a rectangular shape slightly wider than an image formable area of the photoconductor drum 21 in the rotation axis direction. Reference signs 57A and 57B in FIG. 2 are sealing members that prevent the developer (usually, toner) from leaking through a gap between the developing device 5 and the photoconductor drum 21 and a gap between the development opening 50*a* of the housing 50 and the development roller 53.

The development roller 53 holds the developer in the container portion 51 onto the outer circumferential surface of the development roller 53 with a magnetic force. The development roller 53 transports the holding developer to a development area, facing the outer circumferential surface of the photoconductor drum 21 at a predetermined distance, and transfers the developer to the outer circumferential surface. As illustrated in FIG. 2 and other drawings, the development roller 53 includes a cylindrical sleeve 531 and a magnet roller 532. The sleeve 531 is disposed in the housing 50 so as to be rotatable while being partially exposed through the development opening 50*a*. The magnet roller 532 serves as a magnet member fixed in the cylindrical space of the sleeve 531.

The sleeve 531 is a cylindrical member formed from a nonmagnetic material such as stainless steel or aluminum. The sleeve 531 has its both ends rotatably attached to, for example, a shaft portion of the magnet roller 532. A gear, not illustrated, is attached to one end of the sleeve 531. The sleeve 531 rotates in the direction of arrow C as a result of the gear receiving rotational power transmitted from a rotation driving device, not illustrated. A power supply device, not illustrated, applies a development voltage across the sleeve 531 and the photoconductor drum 21. On the other hand, the magnet roller 532 has a structure in which multiple magnetic poles (the S pole and the N pole) are arranged. The magnetic poles produce a magnetic force that adheres the magnetic carrier of the developer to the outer circumferential surface of the sleeve 531 along the line of magnetic force so that the magnetic carrier forms a chained magnetic brush. The magnet roller 532 is attached to the housing 50 such that, for example, the shaft portion of the magnet roller 532, protruding from both ends of the sleeve 531, is fixed to the side walls of the housing 50.

The layer-thickness restricting member 54 restricts the layer thickness of the developer (the magnetic brush) held on the sleeve 531 of the development roller 53 to a substantially uniform thickness.

The layer-thickness restricting member 54 is attached and fixed to the side walls of the housing 50 while having a predetermined gap (a restriction gap) corresponding to the necessary layer thickness of the developer between itself and the outer circumferential surface of the sleeve 531 of the development roller 53 and while being kept facing the sleeve 531 in the axial direction of the sleeve 531. An example usable as the layer-thickness restricting member 54 is a cylindrical member having a length equal to or greater than the length of the effective development area of the development roller 53 (the sleeve 531) in the rotation shaft direction. An example of the layer-thickness restricting member 54 is a member formed from a nonmagnetic material such as stainless steel.

As illustrated in FIGS. 2 and 3 and other drawings, two agitating transport members 55 and 56 are separately arranged in the first transport path 51*a* and the second transport path 51*b* of the housing 50. The agitating transport members 55 and 56 transport the developer held in the respective transport paths 51*a* and 51*b* in predetermined directions (transport directions) indicated with two-dot chain line arrows J1 and J2 while agitating the developer.

Examples used as the agitating transport members 55 and 56 each have a structure (so-called a screw auger) having a rotation shaft 55*a* or 56*a* and a plate-shaped transport portion 55*b* or 56*b* helically wound around on the circumferential surface of the rotation shaft 55*a* or 56*a*. In each of the agitating transport members 55 and 56, both ends of the rotation shaft 55*a* or 56*a* are rotatably attached to bearings, not illustrated, disposed at the side wall surfaces of the housing 50. In each of the agitating transport members 55 and 56, a gear, not illustrated, is attached to one end of the rotation shaft 55*a* or 56*a* so that the rotation shaft 55*a* or 56*a* rotates in a predetermined direction upon receipt of rotation power distributed from the development roller 53 (the sleeve 531). The agitating transport member 56 disposed on the second transport path 51*b*, which is a mixing transport path, is an example of a mixing transport portion that transports the developer in the container portion 51 while mixing the developer with fed toner.

In the container portion 51 in the housing 50, the developer is transported in the following manner.

Firstly, the developer in the second transport path 51*b* is transported in the direction of two-dot chain line arrow J1 from one end to the other end of the second transport path 51*b* while being agitated by the agitating transport member 56. Then, the developer is fed to the first transport path 51*a* through the connection portion 51*d*. The developer in the first transport path 51*a* is transported in the direction of two-dot chain line arrow J2 from one end to the other end of the first transport path 51*a* while being agitated by the agitating transport member 55. Concurrently, a part of the developer is fed toward the development roller 53 and then fed to the second transport path 51*b* through the connection portion 51*e*. In this manner, in the container portion 51, the developer moves so as to repeatedly pass through the first transport path 51*a* and the second transport path 51*b* in turn, so that the developer is transported so as to circulate through the container portion 51 as a whole.

Structure Related to Toner Feeding

The toner feeder 52 is a component that feeds an additional lot of toner 16 to the container portion 51 to compensate for the consumed amount of toner in the developer 15 in the container portion 51.

Figure 4:
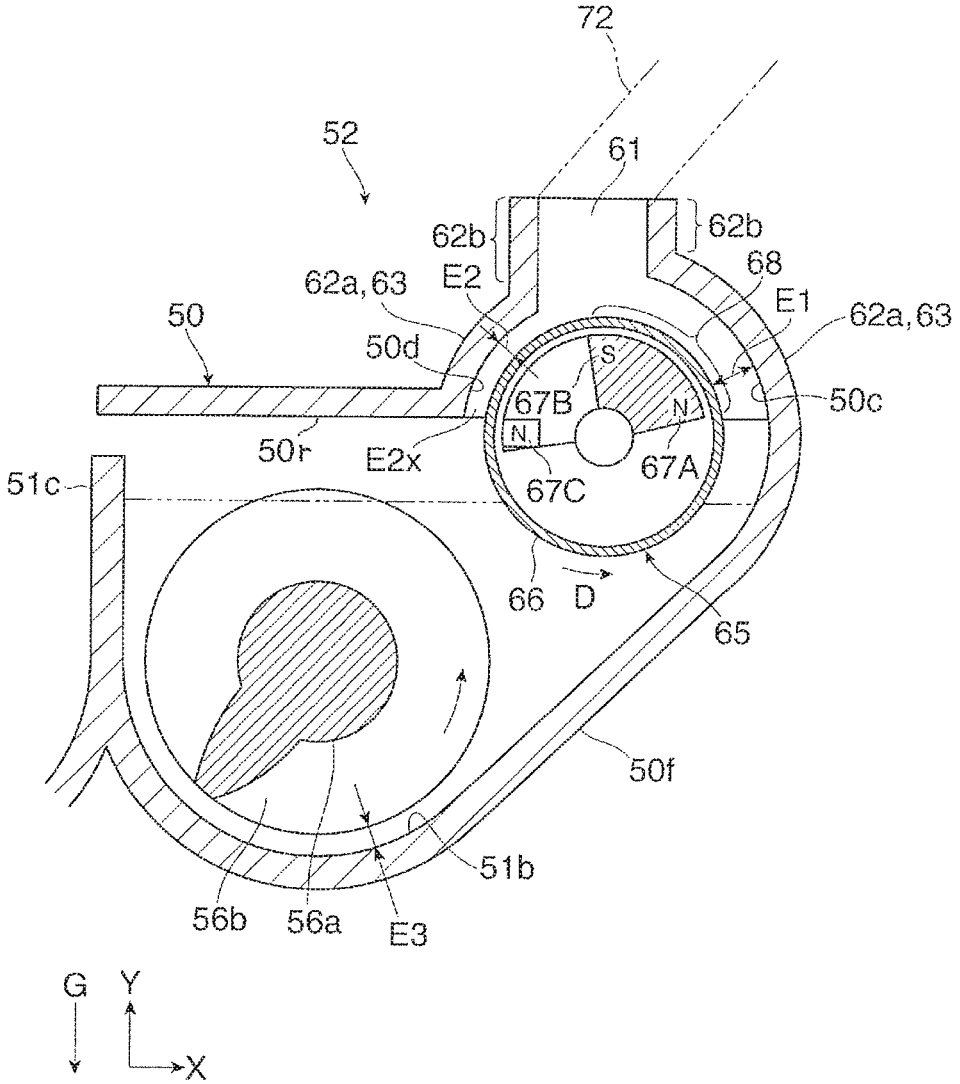
FIG. 4 is an enlarged sectional view of a toner feeder of the developing device in FIG. 2.

As illustrated in FIGS. 2 to 4 and other drawings, the toner feeder 52 includes a feed port member 61 and a rotary member 65. The feed port member 61 is disposed at an upper portion of the second transport path 51*b* of the container portion 51 of the housing 50 to allow the feeding toner 16 to pass therethrough. The rotary member 65 is disposed so as to rotate while facing the feed port member 61 with a predetermined gap E (E1 or E2) therebetween.

The feed port member 61 is formed as an opening that is a rectangular opening when viewed in plan. The feed port member 61 is disposed above a projecting portion 50*f*, which projects obliquely upward on a side opposite to the development roller 53 at an upstream-sided portion of the second transport path 51*b* of the housing 50 in the developer transport direction J1.

The feed port member 61 is disposed on a protruding portion 62, which protrudes a predetermined height upward from the top of the projecting portion 50*f* of the housing 50. The protruding portion 62 is a structural portion including a semi-cylindrical bottom portion 62*a* and an angular-prism top portion 62*b*. The bottom portion 62*a* has an inner wall surface so curved as to substantially correspond to the curve of the outer circumferential surface of the rotary member 65. The angular-prism-shaped top portion 62*b* protrudes upward from substantially the top of the bottom portion 62*a*. The feed port member 61 is an angular-prism-shaped space inside the top portion 62*b* of the protruding portion 62.

As illustrated in FIG. 1 and other drawings, the feed port member 61 is connected to a toner containing unit 70 containing the feeding toner 16. The toner containing unit 70 includes a container 71, which substantially holds the feeding toner 16, and a passage member 72, which transports the toner 16 inside the container 71 to the feed port member 61 of the developing device 5.

An example of the container 71 is a cartridge-form container, detachably attached to a receiving portion, not illustrated, in the housing 10 of the image forming apparatus 1. A transport portion, not illustrated, that transports the feeding toner 16 held in the container 71 to the outlet port, not illustrated, is disposed in the container 71. The passage member 72 is a tubular member serving as a toner transport path connecting the outlet port of the container 71 and the feed port member 61 of the developing device 5. When, for example, the passage member 72 is disposed so as to be inclined downward from the container 71 to the feed port member 61, the feeding toner 16 slidably moves through the path toward the feed port member 61 due to the gravity after being pushed out of the outlet port of the container 71.

While the developing device 5 is in operation, the toner containing unit 70 keeps transporting the feeding toner 16 from the container 71 through the passage member 72 toward the feed port member 61. Thus, in the feed port member 61, the toner 16 accumulates in the space (actually, inside the space above the rotary member 65) inside the protruding portion 62, forming the feed port member 61, to form a toner accumulation 16X (see FIGS. 6A and 6B and other drawings).

The rotary member 65 includes a rotatable cylindrical member 66 and a magnet member 67 disposed in and fixed to the inner space of the cylindrical member 66.

The cylindrical member 66 has an outer diameter greater than the length of the short side of the rectangle of the feed port member 61 when viewed in plan and has a length in the rotation axis direction greater than the length of the long side of the rectangle of the feed port member 61 when viewed in plan. An upper portion of the outer circumferential surface of the cylindrical member 66 is adjacent to a surrounding portion 63 (a portion corresponding to the bottom portion 62*a* of the protruding portion 62) including the feed port member 61 of the housing 50 with a predetermined gap E (E1 or E2) interposed therebetween. The cylindrical member 66 is rotatably attached to the side wall portions of the projecting portion 50*f* of the housing 50 using shank portions 66*a* and 66*b* at both ends of the cylindrical member 66 in the rotation axis direction. A gear, not illustrated, is attached to the end of the shank portion 66*a* of the cylindrical member 66. Rotational power distributed from the agitating transport member 56 (the rotation shaft 56*a* of the agitating transport member 56) is transmitted to the gear so that the cylindrical member 66 rotates in a predetermined direction D.

Specifically, the cylindrical member 66 is disposed in the following manner. An upper portion of the outer circumferential surface of the cylindrical member 66 on the upstream side in the rotation direction D is spaced apart by a first gap E1 from a rear inner wall surface 50*c* of the surrounding portion 63 of the housing 50 including the feed port member 61. An upper portion of the outer circumferential surface of the cylindrical member 66 on the downstream side in the rotation direction D is spaced apart by a second gap E2 from a front inner wall surface 50*d* of the surrounding portion 63 of the housing 50 including the feed port member 61.

The first gap E1 serves as a space through which a developer 15*b* adhered to and held on the outer circumferential surface of the cylindrical member 66 usually passes. The second gap E2 serves as a space through which the feeding toner 16 usually passes when fed to the second transport path 51*b*. The second gap E2 is determined to be, for example, approximately 1 mm, that is, generally smaller than the size of the first gap E1 (for example, 2 mm). The reference sign E3 in FIG. 4 denotes the gap between the inner wall surface of the second transport path 51*b* near the bottom and the plate-shaped transport portion 56*b* of the agitating transport member 56.

The surrounding portion 63 of the housing 50 including the feed port member 61 here denotes the portion serving as the inner wall surfaces of the protruding portion 62 forming the feed port member 61, more specifically, the curved inner wall surfaces 50*c* and 50*d* of the protruding portion 62 at the bottom portion 62*a*.

The cylindrical member 66 is formed from a nonmagnetic material, such as an aluminum alloy. The cylindrical member 66 according to the first exemplary embodiment has its outer circumferential surface in which fine grooves 66*m* linearly extending in the rotation axis direction are formed at regular intervals. Forming these fine grooves 66*m* improves the efficiency of transporting the developer held on the outer circumferential surface of the cylindrical member 66.

The magnet member 67 includes a first magnetic pole (a pick-up magnetic pole) 67A and a second magnetic pole (a holding pole) 67B. The first magnetic pole 67A exerts its magnetic force for attracting the developer located above the reference height H against the gravity and adhering the developer to the outer circumferential surface of the cylindrical member 66 when an upper level (the developer level) 15*a* of the developer held in the second transport path 51*b* of the container portion 51 exceeds a predetermined reference height H (refer to FIG. 6B). The second magnetic pole (the holding pole) 67B exerts its magnetic force for causing the outer circumferential surface of the cylindrical member 66 to keep holding the developer 15*b*, held by the magnetic force of the first magnetic pole 67A, up to the position facing the feed port member 61. The first magnetic pole 67A and the second magnetic pole 67B are magnets extending in the direction along the rotation shaft (the line) of the cylindrical member 66.

Here, the reference height H is the developer level when the container portion 51 of the housing 50 is filled with such an amount of a developer that ensures the development capability of the developing device 5. For example, when the developer level of the developer in the container portion 51 falls below the reference height H, the amount of the developer fed to the development roller 53 runs short and the developer layer held and formed on the development roller 53 may have a partially uneven thickness. In this case, a development failure may partially occur and the development failure may thus cause an image quality degradation of partial image density reduction (for example, a phenomenon called an auger mark).

Here, the reference height H is a concept of substantially specifying the height relative to the rotary member 65, rather than a concept of the physical length of the container portion 51 (in this example, the second transport path 51*b*) in the height direction from the bottom.

The second magnetic pole 67B is a magnetic pole (for example, the S pole) opposite to the first magnetic pole 67A (for example, the N pole). The magnet member 67 thus forms a flux (a magnetic field) of lines of magnetic force directing from the first magnetic pole 67A to the second magnetic pole 67B. This formation of the magnetic field allows the outer circumferential surface of the cylindrical member 66 to adhere and hold the developer thereto and thereon.

The position at which the first magnetic pole 67A is located is determined on the basis of, for example, the distance with which the first magnetic pole 67A is capable of adhering and holding the developer exceeding the reference height H of the developer level to and on the outer circumferential surface of the cylindrical member 66 with the magnetic force of the first magnetic pole 67A. On the other hand, the position at which the second magnetic pole 67B is located is determined on the basis of, for example, the distance over which the second magnetic pole 67B has to transport the developer held on and adhered to the outer circumferential surface of the cylindrical member 66 by the first magnetic pole 67A to at least a predetermined position while holding the developer on the outer circumferential surface of the rotating cylindrical member 66 or on the basis of the predetermined position to which the developer is to be transported.

In the rotary member 65, the magnet member 67 including the first magnetic pole 67A and the second magnetic pole 67B is fixed to and disposed inside the cylindrical member 66. The rotary member 65 thus has a magnetic force generating area 68 on the outer circumferential surface of the cylindrical member 66, which generates a magnetic force for adhering and holding the developer 15*b* to cover (close) the feed port member 61.

Figure 5:
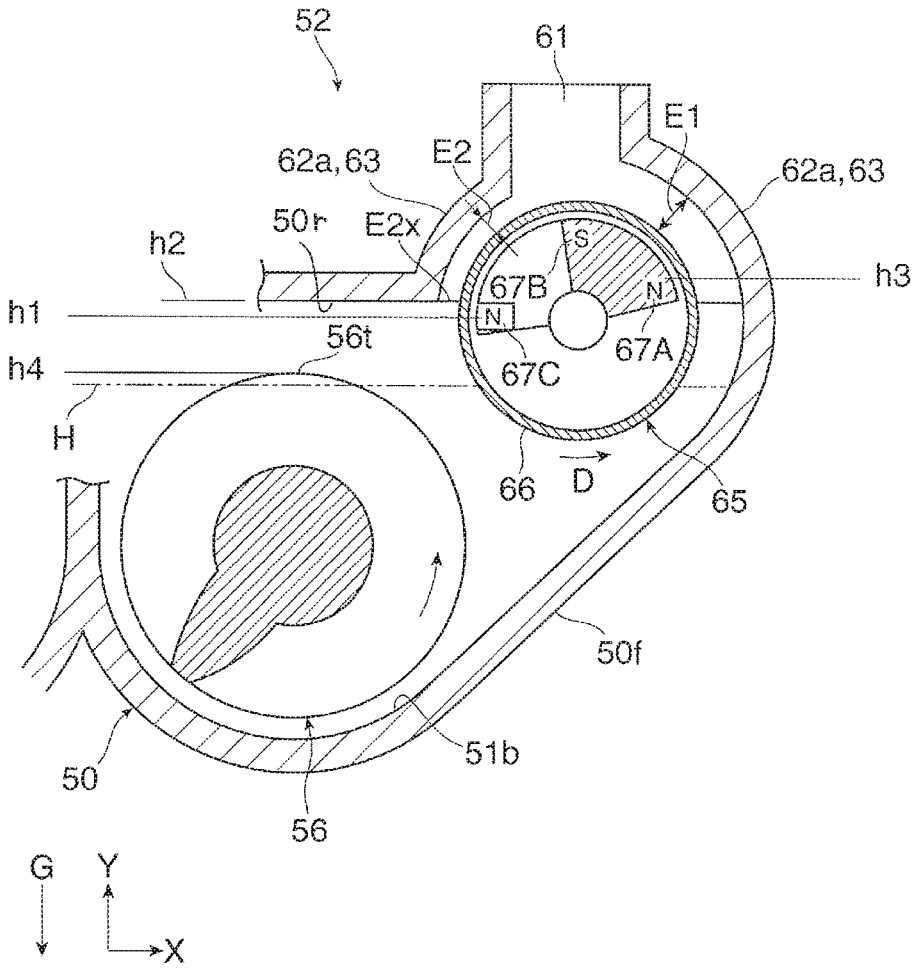
FIG. 5 is a schematic sectional view of the structure of the toner feeder in FIG. 4.

As illustrated in FIGS. 4 and 5 and other drawings, the toner feeder 52 has a developer-level adjusting magnetic pole 67C for use as a third magnetic pole for holding the developer at a position of the magnet member 67 of the rotary member 65 below the height h1 of an end E2*x* of the second gap E2 on a downstream side of the feed port member 61 in the rotation direction. Here, in the developing device 5, the end E2*x* of the second gap E2 is located at the same level (a height h2, described below) as a ceiling inner wall surface portion 50*r* of the housing 50 opposing the agitating transport member 56 in the gravitational direction G.

The developer-level adjusting magnetic pole 67C causes a portion of the outer circumferential surface of the cylindrical member 66 of the rotary member 65 facing the developer-level adjusting magnetic pole 67C to hold the developer and to transport the held developer by rotation in the rotation direction D of the cylindrical member 66. Thus, the developer-level adjusting magnetic pole 67C keeps the developer that is to approach and cover the end E2*x* of the second gap E2 away from the end E2*x*.

An example usable as the developer-level adjusting magnetic pole 67C is a magnetic pole having the magnetic force the same as the magnetic force (for example, approximately 30 mT) of the first magnetic pole 67A or the second magnetic pole 67B. If necessary, however, a magnetic pole having a different force is also usable. The developer-level adjusting magnetic pole 67C may be, for example, the N pole. The end E2*x* of the second gap E2 is an end of the gap E2 on the downstream side of the cylindrical member 66 of the rotary member 65 in the rotation direction D. The height h2 of the end E2*x* of the second gap E2 is located at a position (h2>H) above the reference height H of the developer level.

As illustrated in FIG. 5 and other drawings, the developer-level adjusting magnetic pole 67C according to the first exemplary embodiment is located at a position (h1<h2) below the height h2 of the end E2*x* of the second gap E2, specifically, on the downstream side of the end E2*x* in the rotation direction D of the rotary member 65. The developer-level adjusting magnetic pole 67C is located at a position (h1>H) above the reference height H of the developer level in the gravitational direction G and at a position (h1>h4) above the height h4 of an upper end 56*t* of the agitating transport member 56.

Here, the height h1 of the developer-level adjusting magnetic pole 67C in the gravitational direction G is, for example, a horizontal height that passes the top of the highest line of magnetic force of vertical lines of magnetic force generated on the outer circumferential surface of the cylindrical member 66 from the magnetic pole.

The height h2 of the end E2*x* of the second gap E2 in the gravitational direction G is the lowest height at the boundary between the second gap E2 and the container portion 51 (the second transport path 51*b*).

As illustrated in FIG. 5 and other drawings, the developer-level adjusting magnetic pole 67C according to the first exemplary embodiment is located at a position (h1<h3) below the height h3 of the first magnetic pole 67A, serving as a pick-up magnetic pole, of the magnet member 67, which picks up the developer on the outer circumferential surface of the cylindrical member 66 of the rotary member 65 when the developer exceeds the reference height H of the developer level in the gravitational direction G.

The height h3 of the first magnetic pole 67A, serving as a pick-up magnetic pole, in the gravitational direction G is a height defined similarly as the height h1 of the developer-level adjusting magnetic pole 67C.

As illustrated in FIG. 5 and other drawings, the first magnetic pole 67A is located at the position (h3>h2) above the height h2 of the end E2*x* of the second gap E2 in the gravitational direction G.

As illustrated in FIG. 5 and other drawings, the rotary member 65 according to the first exemplary embodiment is located such that its portion (its lower portion) is located below the height h4 of the upper end 56*t* of the agitating transport member 56, serving as a mixing transport portion, in the gravitational direction G.

Toner is stably fed by an autonomous control of the toner feeder 52 when, for example, the reference height H of the developer level, the height h2 of the end E2*x* of the second gap E2, and the height h3 of the first magnetic pole 67A serving as a pick-up magnetic pole satisfy the condition "H<h2≤h3", more preferably, "H<h2<h3". This condition is easily satisfied when, for example, a portion of the rotary member 65 is located below the height h4 of the upper end 56*t* of the agitating transport member 56 serving as a mixing transport portion, as described above. The height h1 of the developer-level adjusting magnetic pole 67C and the reference height H satisfy the relationship "h1>H". The height h1 of the developer-level adjusting magnetic pole 67C and the height h2 of the end E2*x* of the second gap E2 satisfy the relationship "h1<h2".

Operation of Developing Device

When the image forming apparatus 1 performs an operation such as an image forming operation, in the developing device 5, the sleeve 531 of the development roller 53 and the agitating transport members 55 and 56 start rotating and a development voltage is applied to the sleeve 531 of the development roller 53.

Thus, the two-component developer held in the container portion 51 of the housing 50 is transported in the directions of two-dot chain line arrows J1 and J2 shown in FIG. 3 in the first transport path 51*a* and the second transport path 51*b* in the container portion 51 while being agitated by the rotating agitating transport members 55 and 56 such that the developer circulates as a whole. At this time, the toner in the developer is charged by friction as a result of being fully mixed with the magnetic carrier and electrostatically adheres to the surface of the magnetic carrier.

Subsequently, a part of the developer transported by the agitating transport member 55 located closer to the development roller 53 is adhered to and held on the outer circumferential surface of the sleeve 531 of the development roller 53 by the magnetic force. At this time, the developer is held on the outer circumferential surface of the rotating sleeve 531 in the form of a magnetic brush. The developer thus held is restricted during transportation by the rotation of the sleeve 531 in the direction of arrow C when passing through a predetermined gap (a restriction gap) formed between the sleeve 531 and the layer-thickness restricting member 54 to have a substantially uniform thickness (a magnetic brush height).

Subsequently, the developer that has passed by the layer-thickness restricting member 54 passes through the development opening 50*a* by the rotation of the sleeve 531 in the direction of arrow C and is transported to the development area facing the photoconductor drum 21. The developer transported to the development area is caused to pass by the photoconductor drum 21 while having its magnetic brush tip come into contact with the outer circumferential surface of the photoconductor drum 21. While the developer passes by the photoconductor drum 21, a development (alternating) electric field formed between the development roller 53 and the photoconductor drum 21 by a development voltage including an alternating current fed to the sleeve 531 electrostatically adheres only the toner of the developer to a portion of an electrostatic latent image on the photoconductor drum 21 while moving back and forth between the development roller 53 and the photoconductor drum 21. Thus, the developing device 5 develops an electrostatic latent image.

The developer on the development roller 53 that has passed through the development area without contributing to the development process passes through the development opening 50*a* while being held on the outer circumferential surface of the sleeve 531 by the magnetic force and is transported into the housing 50. Then, the developer generally receives an effect of the repelling magnetic pole of the magnet roller 532 to be separated from the sleeve 531 and returned into the container portion 51 (actually, the first transport path 51*a*). The developer thus separated and returned is transported again through the first transport path 51*a* while being agitated by the agitating transport member 55 and transported back to the first transport path 51*a* again through the second transport path 51*b* in a circulation manner for reuse.

When the developing device 5 performs this development operation, the toner in the developer 15 of the container portion 51 is fed from the development roller 53 to the photoconductor drum 21 and consumed, so that the toner in the developer 15 decreases. Thus, an additional lot of the toner 16 for compensating for the reduced amount of toner is fed to the container portion 51 (the second transport path 51*b*) through the toner feeder 52 from the toner containing unit 70. In the developing device 5, at the initial stage of use, the container portion 51 is filled with an amount of the developer 15 exceeding the reference height H in advance.

When the developing device 5 starts its operation, the rotary member 65 of the toner feeder 52 also starts rotation. Concurrently with the start of the rotation of the rotary member 65, the transport portion of the toner containing unit 70 also starts operating (for example, starts rotating).

Thus, the feeding toner 16 is picked up from the toner containing unit 70 by the transport portion and continuously fed toward the feed port member 61 of the toner feeder 52 through the passage member 72. Thus, as exemplarily illustrated in FIG. 6A, the feeding toner 16 accumulates in the space inside the feed port member 61 and forms a toner accumulation 16X.

Toner Feeding Operation

Figure 6B:
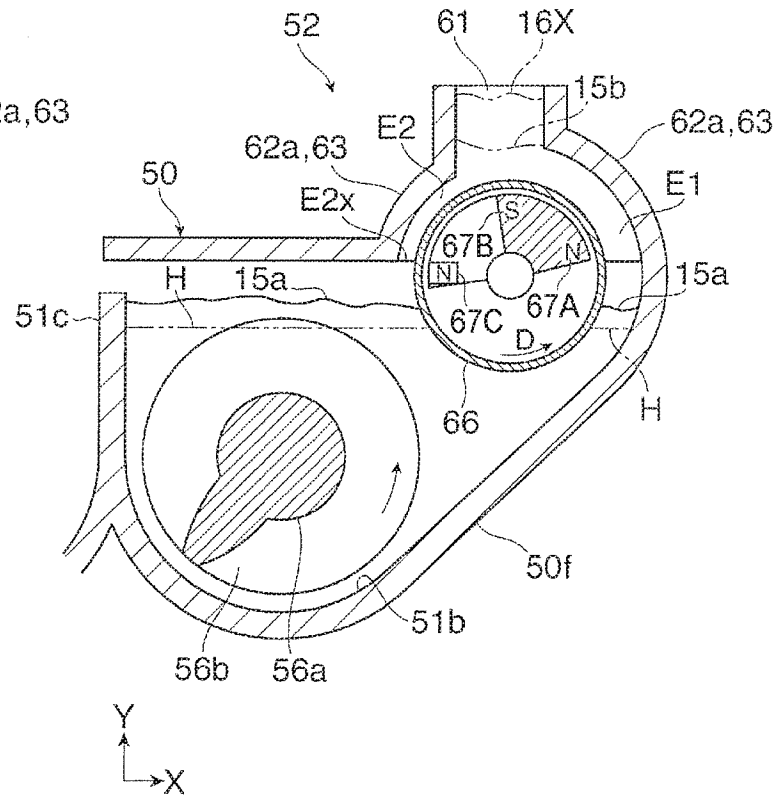
FIG. 6A is a sectional view of a related portion of the toner feeder when the toner feeder is performing toner feeding and FIG. 6B is a sectional view of a related portion of the toner feeder when the toner feeder stops toner feeding.
Figure 6A:
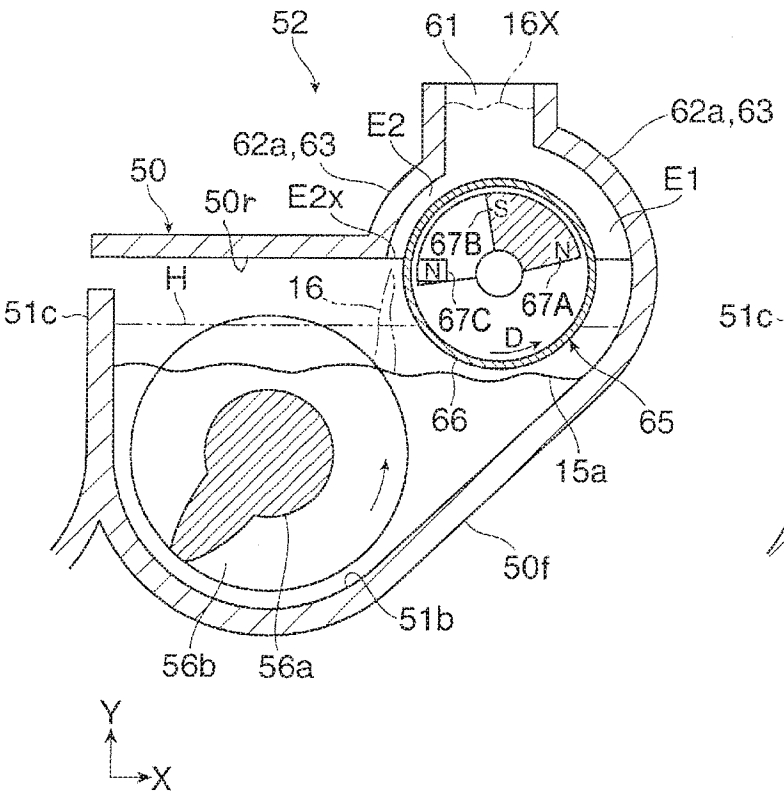

As illustrated in FIG. 6A, first, in the toner feeder 52 of the developing device 5, the upper level (the developer level) 15*a* of the developer held in the container portion 51 lowers when the toner is consumed in the development operation of the developing device 5 and falls below the reference height H.

At this time, in the toner feeder 52, the developer inside the container portion 51 fails to be adhered to and held on the outer circumferential surface of the rotary member 65 (the cylindrical member 66) because the magnetic attracting force of the magnetic force generating area 68 (the first magnetic pole 67A of the magnetic force generating area 68) of the rotary member 65 fails to be exerted on the developer in the container portion 51 or the magnetic attracting force, even it is exerted, fails to work against, for example, the gravity of the developer.

Thus, when the upper level 15*a* of the developer inside the container portion 51 falls below the reference height H, as exemplarily illustrated in FIG. 6A, the developer inside the container portion 51 is neither transported to the feed port member 61 by the rotary member 65 (the cylindrical member 66 of the rotary member 65) nor accumulates in the feed port member 61 or the second gap E2 between the feed port member 61 and the rotary member 65. Thus, at this time, the feed port member 61 is not covered with the developer 15*b* transported while being held on the outer circumferential surface of the rotary member 65, as described below. Specifically, in this case, the feed port member 61 and the second gap E2 are left open.

Thus, in the toner feeder 52, the feeding toner 16, including the toner forming the toner accumulation 16X at the feed port member 61, receives the gravity and the rotational transportation force of the rotary member 65, passes through the second gap E2, and moves so as to fall into the second transport path 51*b* of the container portion 51 for feeding.

At this time, the feeding toner 16, including the toner forming the toner accumulation 16X, does not fall through the first gap E1 in the feed port member 61 for feeding. This is because the toner forming the toner accumulation 16X, located in or around the first gap E1, continuously receives the rotational transportation force of the rotary member 65 rotating in the direction of arrow D and is thus moved toward the second gap E2.

The toner 16 fed to the second transport path 51*b* is mixed by the agitating transport member 56, serving as a mixing transport portion, with the developer 15 that has been in the second transport path 51*b*.

Here, the developing device 5 including the toner feeder 52 is designed for the conditions where the magnetic carrier of the developer held in the container portion 51 is neither discharged from the container portion 51 nor fed to the container portion 51, that is, the amount of the magnetic carrier of the developer does not change generally.

Thus, an increase of the entire amount of the developer inside the container portion 51 due to feeding of the toner 16 from the toner feeder 52 rises (recovers) the toner concentration TC in the developer. On the other hand, the amount of the toner 16 in the developer in the container portion 51 decreases due to a consumption of the toner 16 after the development operation and the reduction thus lowers the toner concentration in the developer.

A repulsive force between the toner and the magnetic carrier caused in the developer may increase the apparent volume of the developer inside the container portion 51 compared to the actual amount (the increased amount) of the developer. In this case, when the amount of the toner in the developer inside the container portion 51 increases due to the feeding of an additional lot of the toner 16, the amount (the bulk) of the developer inside the container portion 51 increases further than the volume of the amount of the toner 16 increased by feeding.

Stop of Toner Feeding Operation

As exemplarily illustrated in FIG. 6B, when the toner feeder 52 of the developing device 5 performs an operation of feeding the toner 16, as described above, the upper level 15*a* of the developer held in the container portion 51 rises and exceeds the reference height H.

At this time, in the toner feeder 52, the magnetic force generating area 68 (the first magnetic pole 67A in the magnetic force generating area 68) of the rotary member 65 exerts the magnetic attracting force on the developer inside the container portion 51. Thus, a portion 15*b* of the increased developer is attracted to and held on the outer circumferential surface of the rotary member 65 (the cylindrical member 66).

Thus, when the upper level 15*a* of the developer exceeds the reference height H, as exemplarily illustrated in FIG. 6B, after the developer portion 15*b* inside the container portion 51 is caused to pass through the first gap E1 by the rotary member 65, the portion 15*b* is transported to the feed port member 61 also upon receipt of the magnetic force of the second magnetic pole 67B in the magnetic force generating area 68. A part of the developer portion 15*b* transported to the feed port member 61 by the rotary member 65 enters the second gap E2 and accumulates therein. The remaining part of the developer portion 15*b* accumulates in the feed port member 61 after being left as a difference by being leveled off at the entrance end (the inlet) of the second gap E2 narrower than the first gap E1. Thus, the feed port member 61 at this time, together with the first gap E1 and the second gap E2, is covered with the developer portion 15*b* transported while being held by the rotary member 65.

In the toner feeder 52, the feeding toner 16, including the toner forming the toner accumulation 16X at the feed port member 61, fails to pass through the second gap E2 covered with the developer portion 15*b* transported by the rotary member 65. Thus, the operation of feeding the toner 16 into the second transport path 51*b* of the container portion 51 is stopped.

Securing Toner Feeding Operation

The toner feeder 52 includes the rotary member 65 including the magnet member 67 including the developer-level adjusting magnetic pole 67C. Thus, if, during the above-described toner feeding operation, the developer inside the container portion 51 (the second transport path 51*b*) located closer to the second gap E2 would rise abnormally, the end E2*x* of the second gap E2 is prevented from being covered with the abnormally rising developer.

Specifically, as exemplarily illustrated in FIG. 6A, when the toner feeder 52 feeds the toner in response to the fall of the upper level 15*a* of the developer inside the container portion 51 below the reference height H, as exemplarily illustrated in FIG. 7, the following effect is obtained even when such a phenomenon occurs that the developer inside the container portion 51 located closer to the second gap E2 abnormally rises and a developer level 15*ab* of the developer approaches the end E2*x* of the second gap E2 even though a developer level 15*aa* of the developer inside the container portion 51 located closer to the first gap E1 has not yet exceeded the reference height H.

First, a developer portion 15*c* that abnormally rises is held on the outer circumferential surface of the cylindrical member 66 of the rotary member 65 by the magnetic force of the developer-level adjusting magnetic pole 67C of the rotary member 65. Concurrently, the developer portion 15*c* receives a transportation force by the rotation of the cylindrical member 66 in the direction of arrow D. Thus, the developer portion 15*c* is transported in a direction away from the end E2*x* of the second gap E2.

Even when another developer portion that abnormally rises occurs subsequently, the developer portion 15*c* held on the outer circumferential surface of the rotary member 65 by the magnetic force of the developer-level adjusting magnetic pole 67C moves the subsequently rising developer portion away from the end E2*x* of the second gap E2.

Figure 15:
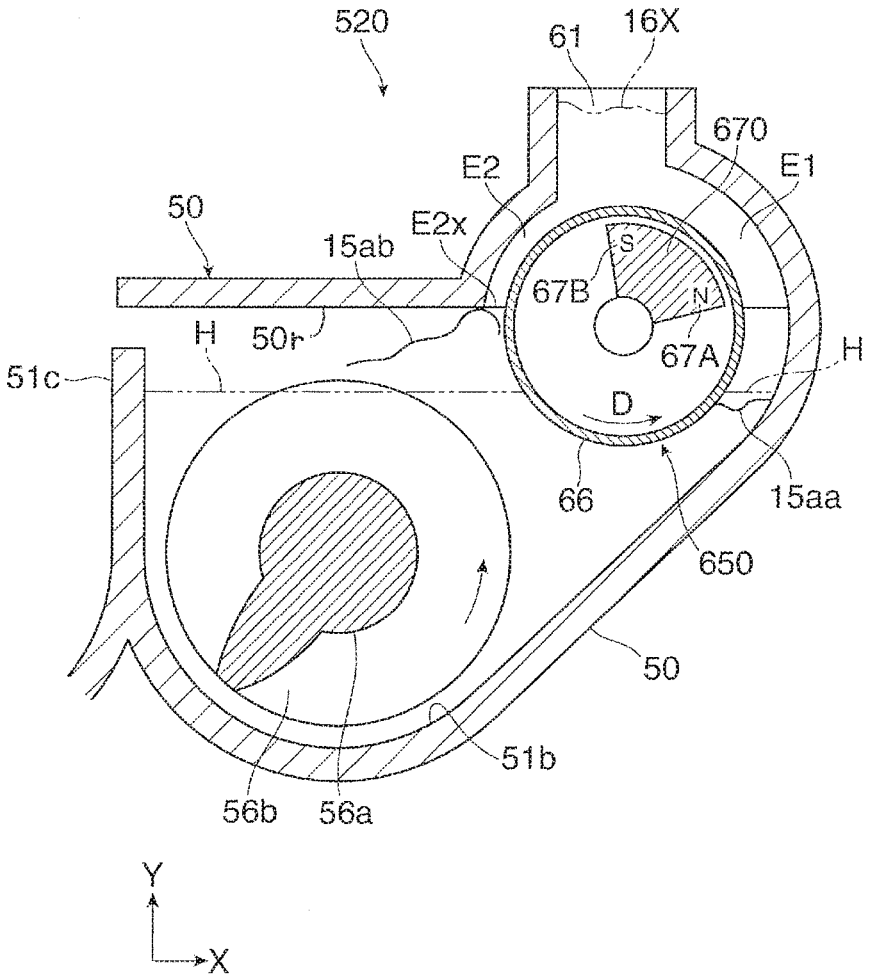
FIG. 15 is a sectional view of a developing device when a toner feeder and other components in the developing device cause a problem in feeding toner or other material.

The end E2*x* of the second gap E2 is thus prevented from being covered with the abnormally rising developer portion (the developer level 15*ab* of the developer portion as in FIG. 15). The second gap E2 between the rotary member 65 and the surrounding portion 63 including the feed port member 61 is thus secured as a path for the toner 16 fed from the feed port member 61 and the toner feeding operation is thus prevented from being hindered.

In the image forming apparatus 1 including the developing device 5, the toner feeding operation of the developing device 5 is prevented from being hindered by a phenomenon possibly caused by the abnormally rising developer portion. Thus, the image quality degradation attributable to the toner feed shortage is prevented. Examples of the image quality degradation here include uneven concentration and reduction in concentration.

On the other hand, if an example of the toner feeder is a toner feeder 520 including a rotary member 650 including a magnet member 670 that does not include the developer-level adjusting magnetic pole 67C, as exemplarily illustrated in FIG. 15, the operation is performed in the following manner.

Specifically, in the toner feeder 520 including the rotary member 650 exemplarily illustrated in FIG. 15, the following phenomenon may occur. A portion of the developer inside the container portion 51 located closer to the second gap E2 abnormally rises and the developer level 15*ab* approaches the end E2*x* of the second gap E2. In this case, the developer portion may cover the end E2*x* of the second gap E2. When the end E2*x* of the second gap E2 is covered with the developer, the second gap E2 fails to function as a path for the toner 16 fed from the feed port member 61. Thus, the toner feeding operation is hindered regardless of the time when toner feeding is intended to be performed.

In the developing device 5, the end E2*x* of the second gap E2 is located at the same level as the ceiling inner wall surface portion 50*r* in the gravitational direction G, as described above. Thus, the space defined by the ceiling inner wall surface portion 50*r* of the housing 50, the agitating transport member 56, and the rotary member 65 may be narrowed for space saving. On the other hand, narrowing the space is more likely to cause the end E2*x* of the second gap E2 to be covered with the abnormally rising developer portion.

In the developing device 5, however, the rotary member 65 includes the developer-level adjusting magnetic pole 67C. Thus, the end E2*x* of the second gap E2 is prevented from being covered with an abnormally rising developer portion regardless of the end E2*x* of the second gap E2 being located in the above positional relationship.

Figure 7:
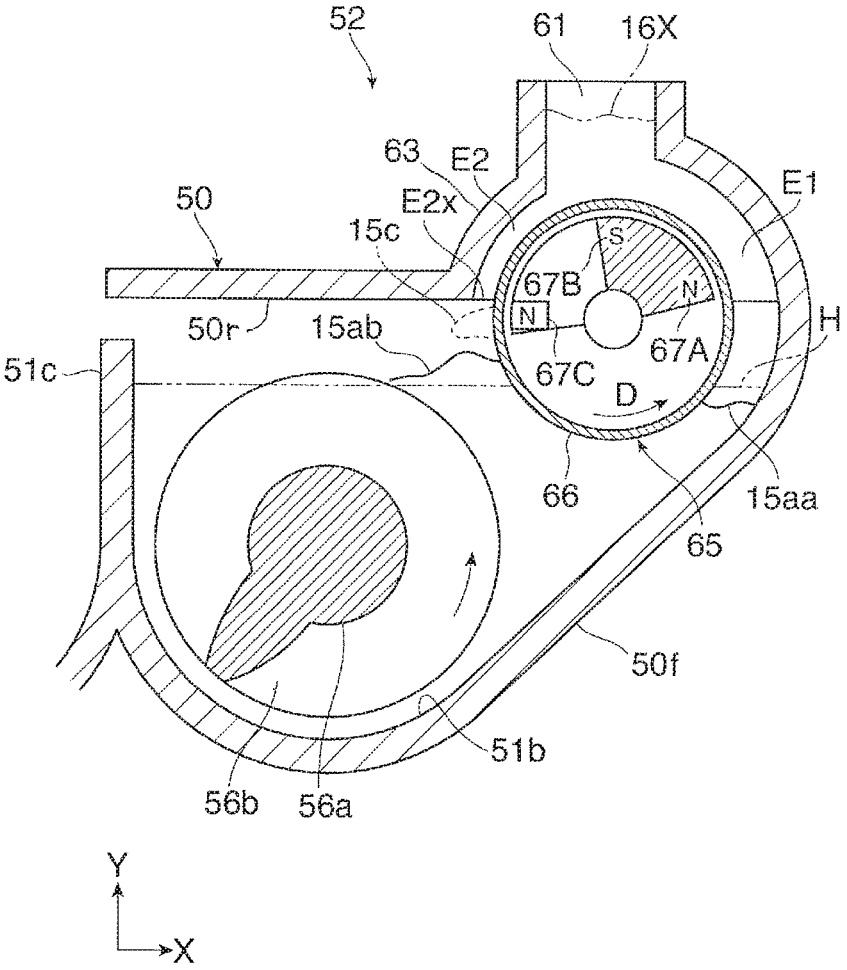
FIG. 7 is a sectional view of a related portion of the toner feeder when the toner feeder is performing a characteristic operation during toner feeding.

As exemplarily illustrated in FIG. 7, in the toner feeder 52 of the developing device 5, the developer-level adjusting magnetic pole 67C of the rotary member 65 is located above the reference height H of the developer level. Thus, in the developing device 5 including the toner feeder 52, unlike in the case where the developer-level adjusting magnetic pole 67C is not located above the reference height H of the developer level, the developer is held and transported by, for example, the magnetic force of the developer-level adjusting magnetic pole 67C of the rotary member 65 even in a middle of a possible rise of a portion of the developer inside the container portion 51 above the reference height H. Thus, the abnormally rising developer portion is appropriately prevented from approaching and covering the end E2*x* of the second gap E2.

As exemplarily illustrated in FIG. 7, in the toner feeder 52 of the developing device 5, the developer-level adjusting magnetic pole 67C of the rotary member 65 is located below the height h3 of the first magnetic pole 67A, serving as a pick-up magnetic pole. Thus, in the developing device 5 including the toner feeder 52, unlike in the case where the developer-level adjusting magnetic pole 67C is not located below the first magnetic pole 67A, the developer level 15*ab* of the developer located closer to the developer-level adjusting magnetic pole 67C is prevented from rising to such an abnormal level as to cover the end E2*x* of the second gap E2 before the developer level 15*a* of the developer located closer to the first magnetic pole 67A arrives at the reference height H.

As exemplarily illustrated in FIG. 7, in the toner feeder 52, the first magnetic pole 67A, serving as a pick-up magnetic pole, is located above the height h2 of the end E2*x* of the second gap E2. Thus, in the developing device 5 including the toner feeder 52, unlike in the case where the first magnetic pole 67A is not located above the height h2 of the end E2*x* of the gap E2, the developer is more easily held and transported on the outer circumferential surface of the rotary member 65 by the magnetic pole of the first magnetic pole 67A even when the developer level 15*a* inside the container portion 51 falls below the reference height H. This structure is thus also capable of preventing the held and transported developer from covering the end E2*x* of the second gap E2.

Besides, in the developing device 5, a portion (a lower portion) of the rotary member 65 is located below the height h4 of the upper end 56*t* of the agitating transport member 56, serving as a mixing transport portion. Thus, in the developing device 5 including the toner feeder 52 (including the rotary member 65), the level of the rotary member 65 of the developing device 5 is further lowered than in the case where a portion of the rotary member 65 is not located below the upper end 56*t* of the height h4 of the upper end 56*t* of the agitating transport member 56.

As illustrated in FIG. 4 and other drawings, in the toner feeder 52, the curved front inner wall surface 50*d* of the surrounding portion 63 extends from the end E2*x* of the second gap E2 along the cylindrical circumferential surface of the rotary member 65 toward the feed port member 61 at a portion of the rotary member 65 upstream of the developer-level adjusting magnetic pole 67C in the rotation direction D of the rotary member 65. Even when the above-described abnormally rising developer portion approaches the end E2*x* of the second gap E2 so as to cover the end E2*x* and enter the second gap E2, the developer portion is prevented from entering due to the narrow entrance of the second gap E2 and the narrow gap space toward the feed port member 61. This structure also prevents the toner feeding operation of the toner feeder 52 from being hindered.

In the developing device 5 including the toner feeder 52 (including the rotary member 65), the end E2*x* of the second gap E2 is located more closer to the container portion 51 (the second transport path 51*b*). Thus, in the developing device 5, the end E2*x* of the second gap E2 is more likely to be covered with the abnormally rising developer portion, as described above. However, the end E2*x* of the second gap E2 is prevented from being covered with the presence of the developer-level adjusting magnetic pole 67C in the rotary member 65.

Second Exemplary Embodiment

Figure 8:
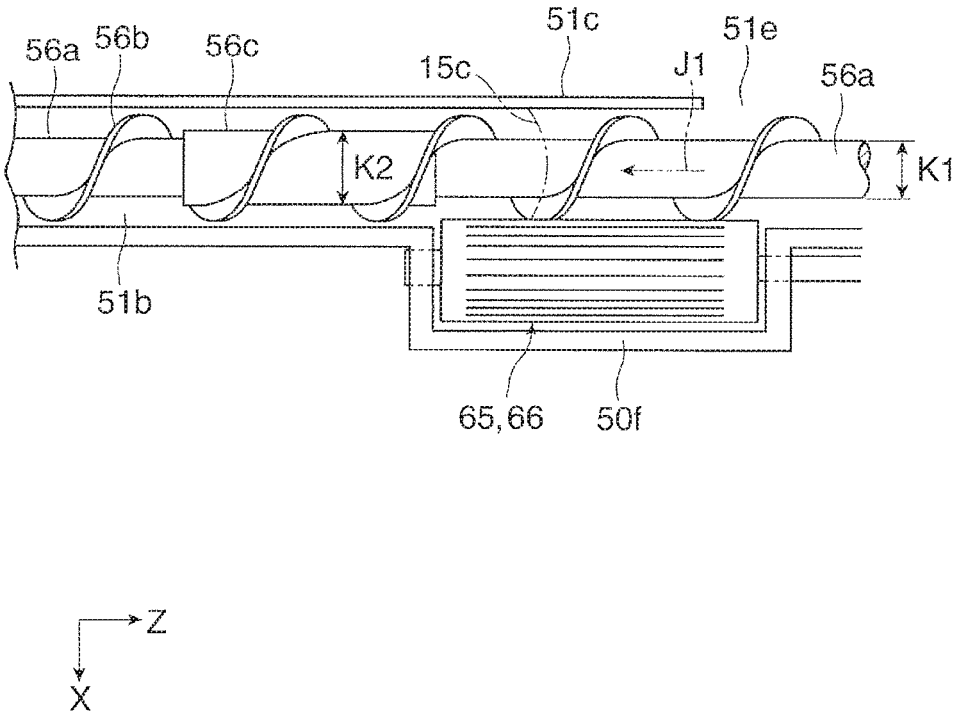
FIG. 8 is an enlarged sectional view of a related portion (including a toner feeder and a thick shaft portion of an agitating transport member) of a developing device according to a second exemplary embodiment.

FIG. 8 illustrates a related portion of a developing device according to a second exemplary embodiment.

A developing device 5 according to the second exemplary embodiment has a similar structure as the developing device 5 according to the first exemplary embodiment except that it additionally includes a thick shaft portion 56*c* in the rotation shaft 56*a* of the agitating transport member 56, serving as a mixing transport portion.

In the developing device 5, the rotation shaft 56*a* of the agitating transport member 56 includes a thick shaft portion 56*c*, which has a shaft diameter K2 greater than a shaft diameter K1 of the other portion of the rotation shaft 56*a* and which is located downstream from the rotary member 65 in the developer transport direction J1. The shaft diameter K2 is, for example, approximately 1 to 2 mm greater than the shaft diameter K1.

Figure 9:
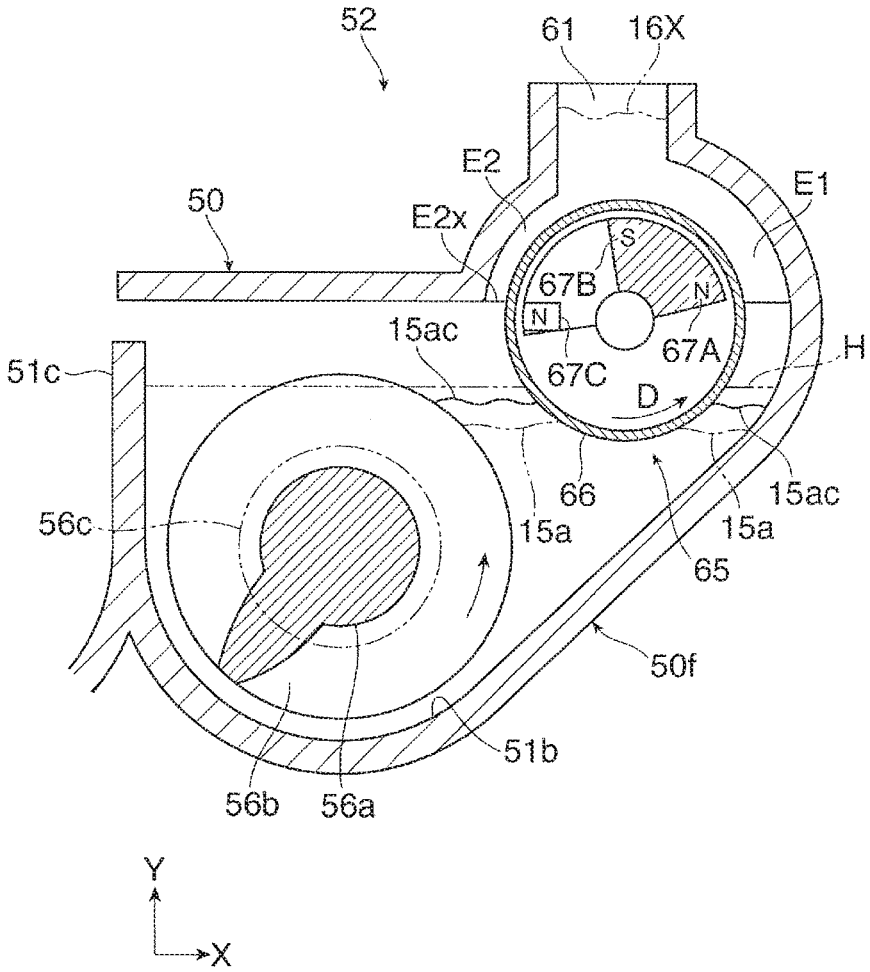
FIG. 9 is a sectional view of a related portion of the toner feeder of the developing device in FIG. 8 when the toner feeder performs toner feeding.

As exemplarily illustrated in FIG. 8 or 9, in the developing device 5 including the agitating transport member 56 including the thick shaft portion 56*c*, a gap area between the container portion 51 (the second transport path 51*b*) and a portion of the rotation shaft 56*a* in which the thick shaft portion 56*c* is located is smaller than the gap area between the container portion 51 and a portion of the rotation shaft 56*a* in which the thick shaft portion 56*c* is not located and thus serves as transportation resistance that degrades the efficiency of transporting the developer.

Compared to the structure, as in the agitating transport member 56 according to the first exemplary embodiment, where the rotation shaft 56*a* has no thick shaft portion 56*c*, in this developing device 5, the developer inside the container portion 51 (the developer portion 15*c* in FIG. 8) is more likely to stay and accumulate at the rotary member 65, located upstream of the thick shaft portion 56*c* of the agitating transport member 56 in the developer transport direction J1, so as to move back to the rotary member 65 (from the upstream end of the thick shaft portion 56*c*). Thus, the developer level 15*ac* of the developer portion 15*c* arrives at the reference height H earlier than the developer level 15*a* of the developer in the case of the agitating transport member 56 that does not include the thick shaft portion 56*c*. Thus, the developer held and transported on the outer circumferential surface of the rotary member 65 appropriately covers the feed port member 61 (and the gaps E1 and E2).

On the other hand, in the developing device 5, the end E2*x* of the second gap E2 is more likely to be covered with a developer portion if the developer portion 15*c* that is more likely to accumulate with the effect of the thick shaft portion 56*c* abnormally rises at a portion closer to the second gap E2. Even in this case, the end E2*x* of the second gap E2 is prevented from being covered with the presence of the developer-level adjusting magnetic pole 67C in the rotary member 65.

Third Exemplary Embodiment

Figure 10:
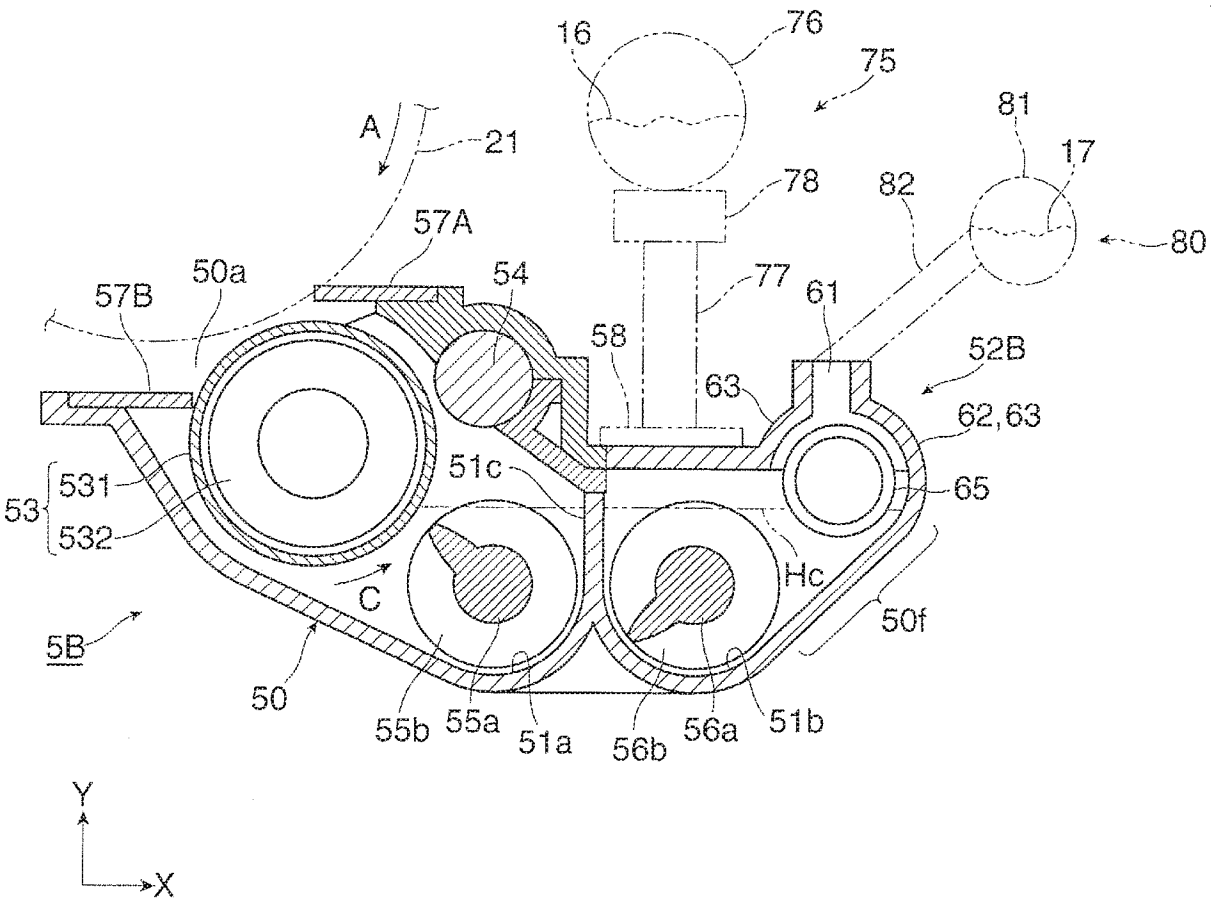
FIG. 10 is a sectional view of a large part of a developing device according to a third exemplary embodiment.
Figure 11:
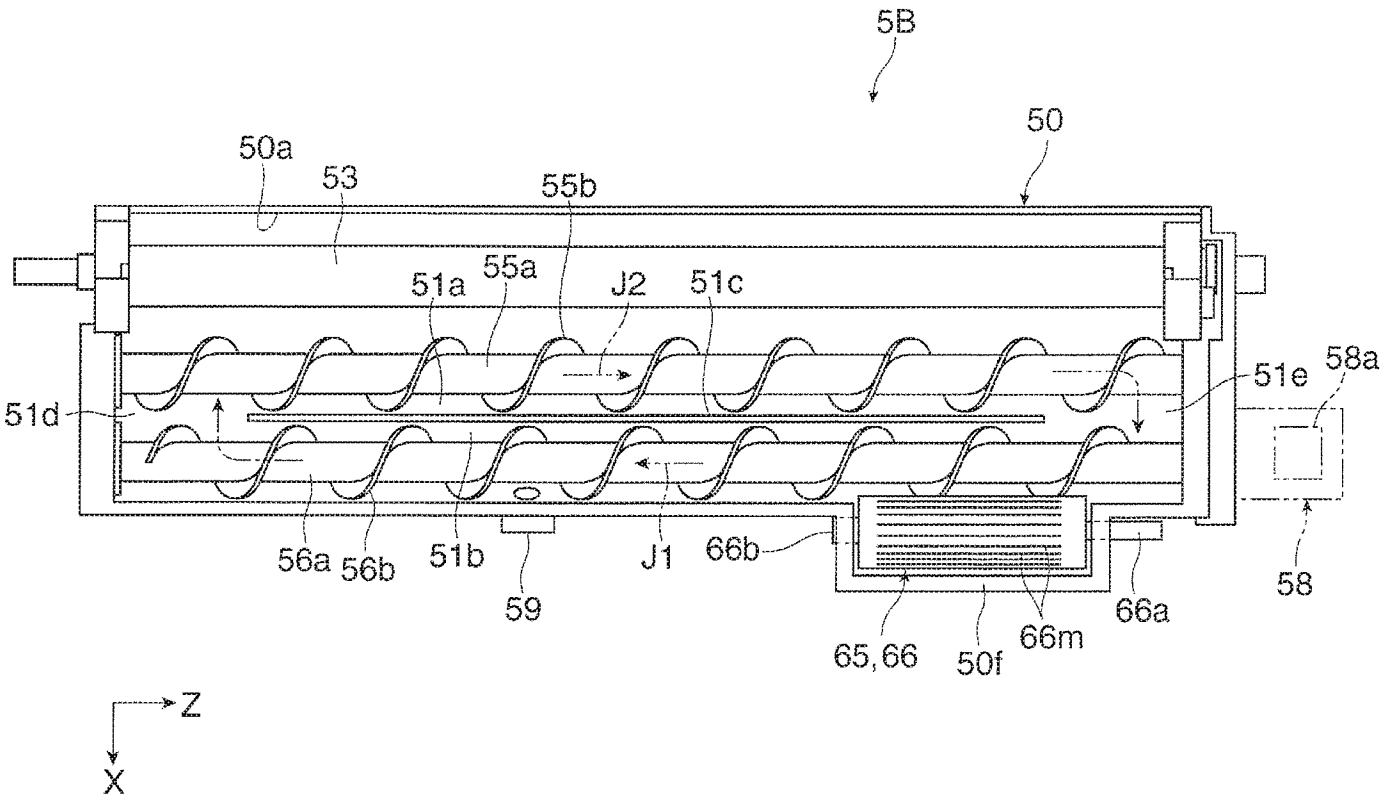
FIG. 11 is a plan view of a portion of the developing device illustrated in FIG. 10.
Figure 12:
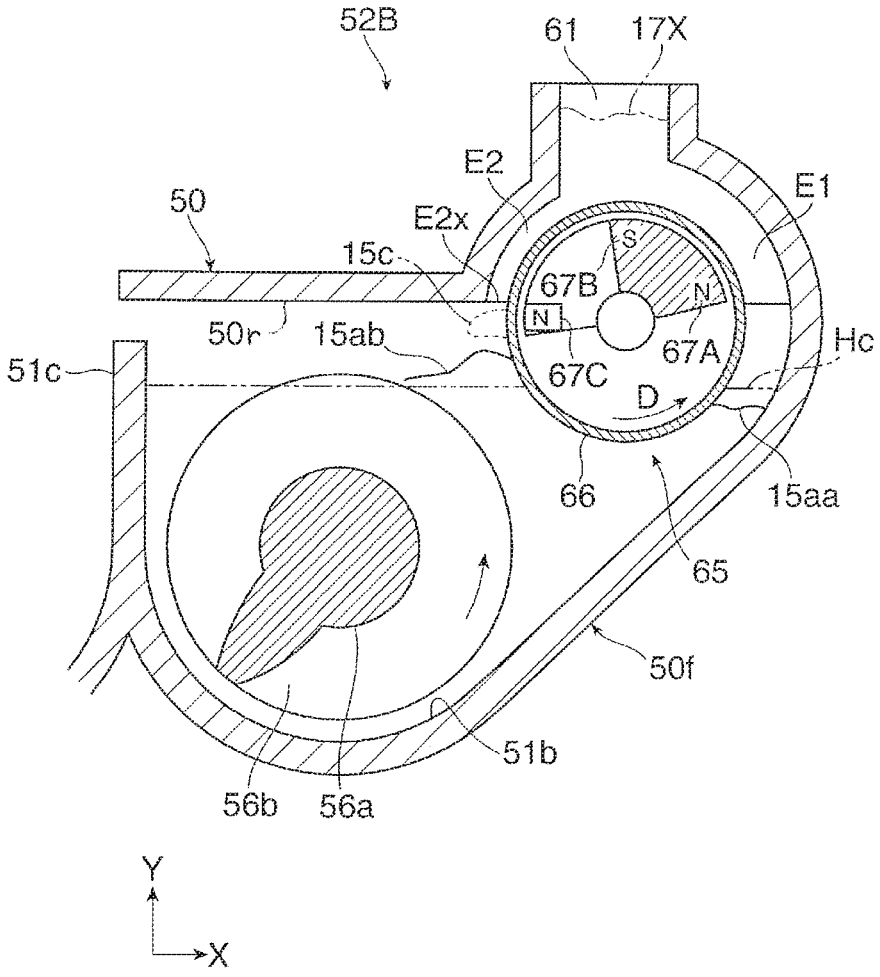
FIG. 12 is a sectional view of a related portion of a carrier feeder of the developing device in FIG. 10 when the carrier feeder performs carrier feeding.

FIGS. 10 to 12 illustrate a developing device according to a third exemplary embodiment. FIG. 10 illustrates the structure of the developing device and the related portions of the developing device. FIG. 11 illustrates a portion of the developing device. FIG. 12 illustrates the other portion of the developing device.

A developing device 5B according to the third exemplary embodiment has a similar structure as the developing device 5 according to the first exemplary embodiment except that it includes a carrier feeder 52B instead of the toner feeder 52 and includes a toner feeder 58 having a different form.

Structure Related to Carrier Feeding

The carrier feeder 52B is a component that performs an operation of feeding an additional lot of a magnetic carrier 17 to the container portion 51 to compensate for the reduction of the magnetic carrier in the developer 15 inside the container portion 51. The magnetic carrier reduction results from, for example, a phenomenon in which the magnetic carrier transfers to the photoconductor drum 21 during a development operation or occurs in an employment of a development form (a trickle development) where a part of the magnetic carrier inside the container portion 51 is discharged and an additional lot of the magnetic carrier is fed.

As illustrated in FIG. 10 and other drawings, the carrier feeder 52B includes a feed port member 61 and a rotary member 65. The feed port member 61 is located at an upper portion of the second transport path 51*b* of the container portion 51 of the housing 50 and allows the feeding magnetic carrier 17 to pass therethrough. The rotary member 65 rotates while facing the feed port member 61 with a predetermined gap E (E1 or E2) interposed therebetween. The feed port member 61 and the rotary member 65 have substantially the same structures as the feed port member 61 and the rotary member 65 in the toner feeder 52 according to the first exemplary embodiment.

As illustrated in FIG. 10, the feed port member 61 is connected to a carrier containing unit 80, which holds the feeding magnetic carrier 17. The carrier containing unit 80 includes a container 81, which actually holds the feeding magnetic carrier 17, and a passage member 82, which transports the magnetic carrier 17 inside the container 81 to the feed port member 61 of the developing device 5. The container 81 and the passage member 82 have substantially the same structures as the container 71 and the passage member 72 of the toner containing unit 70 according to the first exemplary embodiment.

While the developing device 5 is in operation, the carrier containing unit 80 continuously transports the feeding magnetic carrier 17 from the container 81 through the passage member 82 toward the feed port member 61. Thus, the magnetic carrier 17 accumulates at the feed port member 61 in the space inside the protruding portion 62 constituting the feed port member 61 (actually, the space above the rotary member 65) to form a carrier accumulation 17X (refer to FIG. 12).

Carrier Feeding Operation

In the carrier feeder 52B of the developing device 5B, the upper level (the developer level) 15*a* of the developer held in the container portion 51 lowers due to the reduction of the magnetic carrier and falls below the reference height Hc (refer to FIG. 6A). The reference height Hc may be the same as or different from the reference height H in the case of the toner feeder 52.

When the upper level 15*a* of the developer inside the container portion 51 falls below the reference height Hc, neither the developer inside the container portion 51 is transported to the feed port member 61 by the rotary member 65 (the cylindrical member 66 of the rotary member 65) nor the feed port member 61 is covered with the developer 15*b* transported while being held on the outer circumferential surface of the rotary member 65 (refer to FIG. 6A). Specifically, in this case, the feed port member 61 and the second gap E2 are left open.

Thus, in the carrier feeder 52B, the feeding magnetic carrier 17 including the magnetic carrier formed into the carrier accumulation 17X at the feed port member 61 passes through the second gap E2 upon receipt of the gravity and the rotational transportation force of the rotary member 65 and falls into the second transport path 51*b* of the container portion 51 for feeding.

At this time, the magnetic carrier 17 fed to the second transport path 51*b* is mixed by the agitating transport member 56, serving as a mixing transport portion, with the developer 15 that has been in the second transport path 51*b*.

Stop of Carrier Feeding Operation

In the carrier feeder 52B of the developing device 5, when the magnetic carrier 17 performs a feeding operation, the upper level 15*a* of the developer contained in the container portion 51 exceeds the reference height Hc (refer to FIG. 6B).

In the carrier feeder 52B, at this time, the magnetic attracting force of the magnetic force generating area 68 (the first magnetic pole 67A of the magnetic force generating area 68) of the rotary member 65 is exerted on the developer inside the container portion 51, so that a portion of the increased developer 15*b* is attracted to and held on the outer circumferential surface of the rotary member 65 (the cylindrical member 66).

When the upper level 15*a* of the developer exceeds the reference height Hc, the developer portion 15*b* inside the container portion 51 is transported to the feed port member 61 while being held on the rotary member 65 and then a part of the developer portion 15*b* enters the second gap E2 and stays in the second gap E2. The remaining part of the developer portion 15*b* accumulates in the feed port member 61 after being left as a difference by being leveled off at the entrance end (the inlet) of the second gap E2. Thus, the feed port member 61, together with the first gap E1 and the second gap E2, is covered with the developer portion 15*b* transported while being held by the rotary member 65 (refer to FIG. 6B).

In the carrier feeder 52B, the feeding magnetic carrier 17 including the magnetic carrier forming the carrier accumulation 17X at the feed port member 61 fails to pass through the second gap E2 covered with the developer portion 15*b* transported by the rotary member 65. Thus, the operation of feeding the magnetic carrier 17 into the second transport path 51*b* of the container portion 51 is stopped.

Securing Carrier Feeding Operation

The carrier feeder 52B includes the rotary member 65 including the magnet member 67 including the developer-level adjusting magnetic pole 67C. Thus, if, during the above-described carrier feeding operation, the developer inside the container portion 51 (the second transport path 51*b*) located closer to the second gap E2 would rise abnormally, the end E2*x* of the second gap E2 is prevented from being covered with the abnormally rising developer.

Specifically, when the carrier feeder 52B feeds the carrier in response to the fall of the upper level 15*a* of the developer inside the container portion 51 below the reference height Hc (refer to FIGS. 6A and 12), as illustrated in FIG. 12, the following effect is obtained as in the case of the toner feeder 52 according to the first exemplary embodiment, even when such a phenomenon occurs that the developer inside the container portion 51 located closer to the second gap E2 abnormally rises and the developer level 15*ab* approaches the end E2*x* of the second gap E2 even though the developer level 15*aa* of the developer inside the container portion 51 located closer to the first gap E1 has not yet exceeded the reference height H.

Also in this case, first, as exemplarily illustrated in FIG. 12, the developer portion 15*c* that abnormally rises is held on the outer circumferential surface of the cylindrical member 66 of the rotary member 65 by the magnetic force of the developer-level adjusting magnetic pole 67C of the magnet member 67 of the rotary member 65. Concurrently, the developer portion 15*c* receives a transportation force by the rotation of the cylindrical member 66 in the direction of arrow D. Thus, the developer portion 15*c* is transported in a direction away from the end E2*x* of the second gap E2.

Even when another developer portion that abnormally rises occurs subsequently, the developer portion 15*c* held on the outer circumferential surface of the rotary member 65 by the magnetic force of the developer-level adjusting magnetic pole 67C moves the subsequently rising developer portion away from the end E2*x* of the second gap E2.

The end E2*x* of the second gap E2 is thus prevented from being covered with the abnormally rising developer portion (the developer level 15*ab*). The second gap E2 is thus secured as a path for the magnetic carrier 17 fed from the feed port member 61 and the carrier feeding operation is thus prevented from being hindered.

In the image forming apparatus 1 including the developing device 5, the carrier feeding operation of the developing device 5 is prevented from being hindered by the above-described phenomenon. Thus, the image quality degradation attributable to the carrier feed shortage is prevented. Examples of the image quality degradation here include fogging and colored streaks.

Structure Related to Toner Feeding

The toner feeder 58 of the developing device 5B performs toner feeding with an automatic control in accordance with the detected result of the toner concentration TC of the developer inside the container portion 51.

Specifically, as illustrated in FIGS. 10 and 11 and other drawings, the toner feeder 58 includes a toner feeding device 75, a toner concentration detector (a concentration sensor) 59, and a controller, not illustrated. The toner feeding device 75 feeds a feeding toner 16 to the toner feeder 58 with an automatic control. The toner concentration detector 59 detects the toner concentration TC of the developer inside the container portion 51. The controller controls the operation of the toner feeding device 75 on the basis of the detection result of the toner concentration detector 59.

The toner feeder 58 is a portion formed by protruding, to the outer side of the housing 50, one end portion of the second transport path 51*c* of the container portion 51 in the longitudinal direction. The toner feeder 58 has an inlet port 58*a* on the upper surface to receive a feeding toner 16. An extended portion of one end portion of the agitating transport member 56 is disposed in the protruding toner feeder 58. An example usable as the toner concentration detector 59 is a sensor that detects magnetic permeability.

The toner feeding device 75 includes a container 76, which actually holds the feeding toner 16, a passage member 77, which transports the toner 16 inside the container 76 to the inlet port 58*a* of the developing device 5, and a discharging device 78, which actually feeds the toner 16 inside the container 76 to the passage member 77 in accordance with the detection result of the toner concentration detector 59.

The container 76 and the passage member 77 have substantially the same structures as the container 71 and the passage member 72 of the toner containing unit 70 according to the first exemplary embodiment. The passage member 77 has its end connected to the inlet port 58*a*.

The discharging device 78 includes a body portion that temporarily stores the toner 16 discharged from the container 76 and a transport portion that discharges the stored toner 16 toward the passage member 77 during the feeding operation. The controller controls the discharging operation of the transport portion (actually, the operation of the driving portion of the transport portion) of the discharging device 78 in accordance with the detection result of the toner concentration detector 59.

Toner Feeding Operation

In the toner feeder 58, the discharging device 78 of the toner feeding device 75 is actuated to discharge the toner 16 inside the container 76 to the passage member 77 when the result of the toner concentration TC detected by the toner concentration detector 59 falls below a predetermined reference value. Thus, the feeding toner 16 is fed through the inlet port 58*a*. The fed toner 16 is transported to the body portion of the second transport path 51*b* by the agitating transport member 56 and then mixed with the developer that has been in the second transport path 51*b*.

In the toner feeder 58, when the result of the toner concentration TC detected by the toner concentration detector 59 arrives at the reference value, the operation of the discharging device 78 of the toner feeding device 75 is stopped and thus the operation of feeding the feeding toner 16 is also stopped.

In the developing device 5B, when the detection result of the toner concentration TC falls below the reference value, the toner in the developer inside the container portion 51 is consumed and thus reduced. In accordance with the reduction of the toner, the upper level (the developer level) 15*a* of the developer inside the container portion 51 also decreases. At this time, when the upper level (the developer level) 15*a* of the developer inside the container portion 51 falls below the reference height Hc, the carrier feeder 52B performs the above-described operation of feeding the magnetic carrier 17.

Other Exemplary Embodiments

Figure 13A:
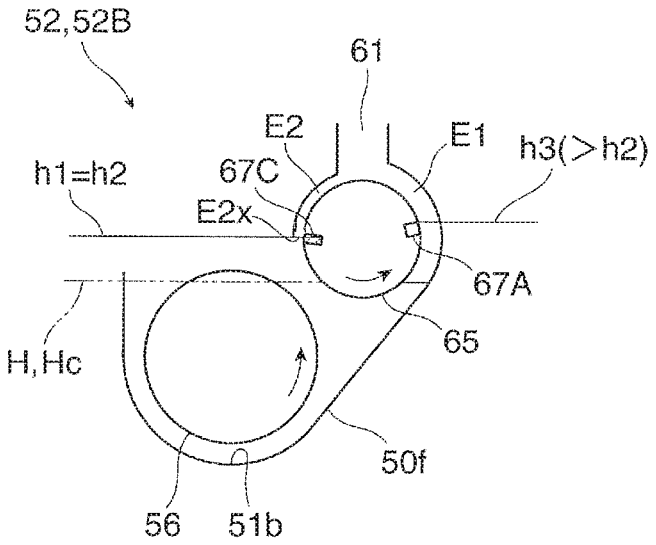
FIGS. 13A and 13B are schematic diagrams of other structure examples of a rotary member in a carrier feeder or a toner feeder of a developing device.

The first to third exemplary embodiments exemplarily illustrate the case where the developer-level adjusting magnetic pole 67C of the rotary member 65 of the toner feeder 52 or the carrier feeder 52B is located at a position (h1<h2) downstream from the height h2 of the end E2*x* of the second gap E2 in the rotation direction D of the rotary member 65. As exemplarily illustrated in FIG. 13A, in another example usable as the rotary member 65, the developer-level adjusting magnetic pole 67C (of the height h1) may be located at the same level (h1=h2) as the height h2 of the end E2*x* of the second gap E2.

The rotary member 65 having the above structure is capable of preventing the above-described toner or carrier feeding from being hindered and, for example, preventing a sudden feed (an addition) during the toner or carrier feeding.

Figure 13B:
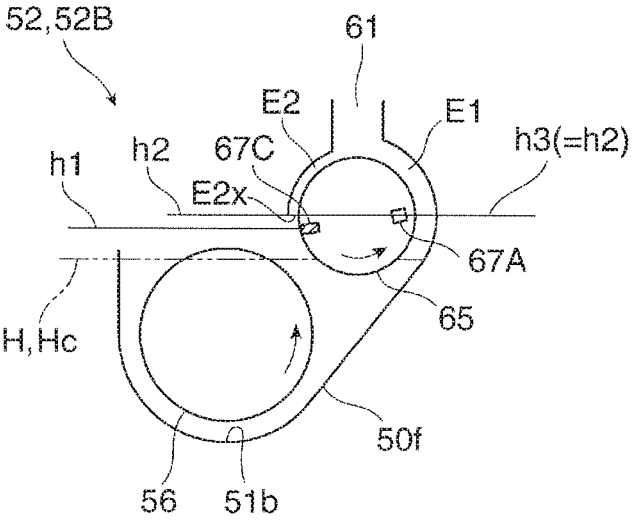

The first to third exemplary embodiments exemplarily illustrate the case where the first magnetic pole 67A, serving as a pick-up magnetic pole, of the rotary member 65 of the toner feeder 52 or the carrier feeder 52B is located above the height h2 of the end E2*x* of the second gap E2. As exemplarily illustrated in FIG. 13B, in another example usable as the rotary member 65, the first magnetic pole 67A (of the height h3), serving as a pick-up magnetic pole, may be located at the same level as the height h2 of the end E2*x* of the second gap E2.

The rotary member 65 having the above structure is capable of preventing the above-described toner or carrier feeding from being hindered and, for example, facilitating transition from the start to the end of the toner or carrier feeding.

The first to third exemplary embodiments exemplarily illustrate the case where the end E2*x* of the second gap E2 is located at the same level as the ceiling inner wall surface portion 50*r* of the housing 50. However, the end E2*x* of the second gap E2 may be located higher than the ceiling inner wall surface portion 50*r* in the gravitational direction G.

In this case, the ceiling inner wall surface portion 50*r* of the housing 50 is allowed to be located closer to the upper end 56*t* of the agitating transport member 56. Thus, the space defined by the ceiling inner wall surface portion 50*r* of the housing 50, the agitating transport member 56, and the rotary member 65 is allowed to be rendered further smaller, and may thus achieve further space saving.

Figure 14A:
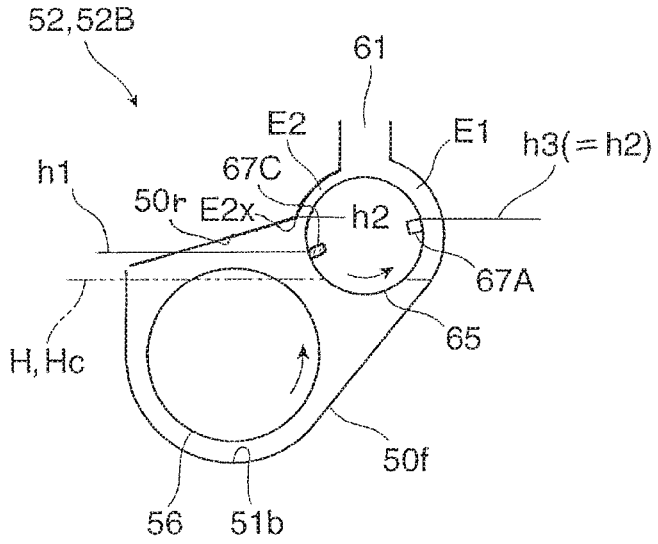
FIGS. 14A and 14B are schematic diagrams of other structure examples of a rotary member in a part of a housing, a toner feeder, and a carrier feeder of a developing device.
Figure 14B:
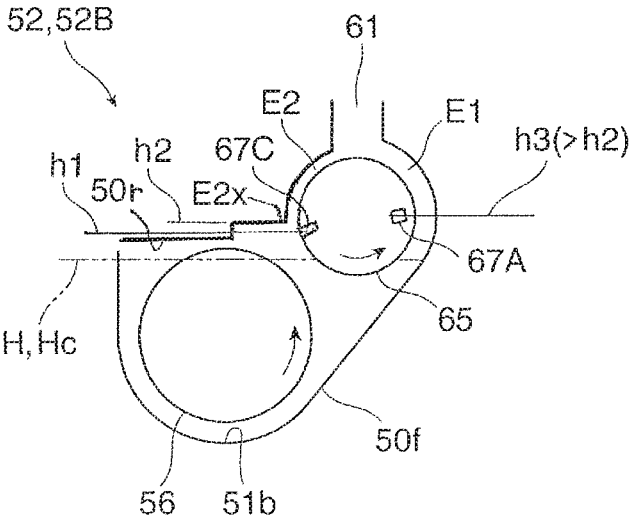

The form of the ceiling inner wall surface portion 50*r* that is located further closer to the upper end 56*t* of the agitating transport member 56 is different from the form (refer to FIG. 5 and other drawings) of the plane at the same level in the horizontal direction as the end E2*x* the gap E2 exemplarily illustrated in the first to third exemplary embodiments. The structure is, for example, the portion 50*r* having a shape of an inclined surface that approaches obliquely downward the agitating transport member 56 from the end E2*x* of the gap E2, as exemplarily illustrated in FIG. 14A, or the portion 50*r* having a shape of a stepped surface that approaches the agitating transport member 56 stepwise from the end E2*x* of the gap E2, as exemplarily illustrated in FIG. 14B. In the two examples illustrated in FIGS. 14A and 14B, the developer-level adjusting magnetic pole 67C is located downstream from the end E2*x* of the gap E2 in the rotation direction of the rotary member 65.

The first to third exemplary embodiments exemplarily illustrate the image forming apparatus 1 that forms a single color image using a single developing device 5 or 5B. However, the image forming apparatus 1 may be an image forming apparatus that forms a multi-color image using multiple developing devices 5 or 5B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device, comprising:

a housing including a container configured to hold a developer containing toner and a magnetic carrier;

a feed port member configured to allow toner or a magnetic carrier to pass therethrough to be fed into the container;

a rotary member spaced apart by a gap from a surrounding portion of the housing, the surrounding portion including the feed port member, the rotary member being configured to transport the developer while holding the developer on an outer circumferential surface of the rotary member to cover the gap when a developer level of the developer inside the container exceeds a reference level; and a developer-level adjusting magnetic pole configured to hold the developer and that is located at a same level as an end of the gap located downstream from the feed port member in a rotation direction of the rotary member or located downstream from the end of the gap in the rotation direction of the rotary member, wherein the developer-level adjusting magnetic pole is located below a pick-up magnetic pole configured to pick up the developer on the outer circumferential surface of the rotary member when the developer level exceeds the reference level in a gravitational direction.

2. The developing device according to claim 1, wherein the developer-level adjusting magnetic pole is located above the reference level of the developer level in a gravitational direction.

3. The developing device according to claim 1, further comprising:

a mixing transport portion including a rotation shaft and a transport portion disposed around the rotation shaft, the transport portion being configured to transport the developer inside the container by rotation while mixing the developer with fed toner or a fed magnetic carrier, wherein the developer-level adjusting magnetic pole is located above an upper end of the mixing transport portion in a gravitational direction.

4. The developing device according to claim 1, wherein the pick-up magnetic pole is located at the same level as or above the end of the gap in the gravitational direction.

5. The developing device according to claim 1, further comprising:

a mixing transport portion including a rotation shaft and a transport portion disposed around the rotation shaft, the transport portion being configured to transport the developer inside the container by rotation while mixing the developer with fed toner or a fed magnetic carrier, wherein the rotation shaft of the mixing transport portion has a thick shaft portion at a portion downstream from the rotary member in a developer transport direction, the thick shaft portion having a shaft diameter greater than a shaft diameter of another portion of the rotation shaft.

6. The developing device according to claim 1, further comprising:

a mixing transport portion including a rotation shaft and a transport portion disposed around the rotation shaft, the transport portion being configured to transport the developer inside the container by rotation while mixing the developer with fed toner or a fed magnetic carrier, wherein a portion of the rotary member is located below an upper end of the mixing transport portion in a gravitational direction.

7. The developing device according to claim 1, further comprising:

a mixing transport portion including a rotation shaft and a transport portion disposed around the rotation shaft, the transport portion being configured to transport the developer inside the container by rotation while mixing the developer with fed toner or a fed magnetic carrier, wherein the end of the gap is located at the same level as or above a ceiling inner wall surface portion of the housing that opposes the mixing transport portion in a gravitational direction.

8. An image forming apparatus, comprising:

an image carrier configured such that electrostatic latent images may be formed on the image carrier; and the developing device according to claim 1 configured to develop the electrostatic latent images on the image carrier.

* * * * *